US009522477B2

(12) United States Patent
Endoh

(10) Patent No.: US 9,522,477 B2
(45) Date of Patent: Dec. 20, 2016

(54) CORRUGATED PAPERBOARD BOX MAKING MACHINE

(71) Applicant: Kabushiki Kaisha Isowa, Aichi (JP)

(72) Inventor: Takao Endoh, Aichi (JP)

(73) Assignee: Kabushiki Kaisha Isowa, Aichi (JP)

( * ) Notice: Subject to any disclaimer, the term of this patent is extended or adjusted under 35 U.S.C. 154(b) by 0 days.

(21) Appl. No.: 14/259,883

(22) Filed: Apr. 23, 2014

(65) Prior Publication Data

US 2014/0326119 A1 Nov. 6, 2014

(30) Foreign Application Priority Data

May 2, 2013 (JP) ..... 2013-097083

(51) Int. Cl.

| | |
|---|---|
| ***B26B 3/00*** | (2006.01) |
| ***B26D 9/00*** | (2006.01) |
| ***B26D 3/14*** | (2006.01) |
| ***B26D 5/00*** | (2006.01) |
| ***B26D 5/02*** | (2006.01) |
| ***B26D 5/04*** | (2006.01) |
| ***B26D 7/26*** | (2006.01) |

(Continued)

(52) U.S. Cl.

CPC ..... *B26D 9/00* (2013.01); *B26D 1/425* (2013.01); *B26D 3/14* (2013.01); *B26D 5/00* (2013.01); *B26D 5/02* (2013.01); *B26D 5/04* (2013.01); *B26D 7/2642* (2013.01); *B26F 1/12* (2013.01); *B31B 1/00* (2013.01); *B26D 1/405* (2013.01); *B26D 1/42* (2013.01); *B26D 2011/005* (2013.01); *B26F 1/384* (2013.01); *B31B 2201/0247* (2013.01); *B31B 2201/147* (2013.01); *B31B 2203/066* (2013.01); *B31B 2203/082* (2013.01); *Y10T 83/4699* (2015.04)

(58) Field of Classification Search

CPC ..... B31B 1/00; B31B 2201/005; B31B 2201/0247; B31B 2203/066; B31B 2203/082; B26D 7/2642; B26D 5/02; B26D 3/14; B26D 1/425; B26D 1/405; B26D 1/42; B26D 5/00; B26D 5/04; B26D 2011/005; Y10T 83/4699; B26F 1/12; B26F 1/384

USPC ..... 83/301, 302, 373, 370, 367, 360

See application file for complete search history.

(56) References Cited

U.S. PATENT DOCUMENTS 4,306,476 A * 12/1981 Saunders et al. ..... 83/117
4,985,012 A * 1/1991 Marschke ..... 493/373

(Continued)

FOREIGN PATENT DOCUMENTS

| | | |
|---|---|---|
| JP | 02-089629 A | 3/1990 |
| JP | 08-500297 A | 1/1996 |
| JP | 2002-067190 A | 3/2002 |

*Primary Examiner* — Omar Flores Sanchez

(74) *Attorney, Agent, or Firm* — Stroock & Stroock & Lavan LLP

(57) ABSTRACT

A corrugated paperboard box making machine, which includes: a slotter for slotting a corrugated paperboard sheet to form slots; a die-cutter disposed downstream of the slotter, the die-cutter including a die cylinder with a punching die and an anvil cylinder; a cutting blade for cutting, in cooperation with the anvil cylinder, the corrugated paperboard sheet slotted by the slotter, into two small-size corrugated paperboard sheets, along a direction perpendicular to the conveyance direction; and a displacement mechanism for displacing the cutting blade as to allow the cutting blade to be selectively set in a cutting position and a non-cutting position.

2 Claims, 10 Drawing Sheets

(51) Int. Cl.

| | |
|---|---|
| ***B26F 1/12*** | (2006.01) |
| ***B31B 1/00*** | (2006.01) |
| *B26D 1/40* | (2006.01) |
| *B26D 1/42* | (2006.01) |
| *B26F 1/38* | (2006.01) |
| *B26D 11/00* | (2006.01) |

(56) References Cited

U.S. PATENT DOCUMENTS

| | | | | | |
|---|---|---|---|---|---|
| 5,297,462 | A | * | 3/1994 | Creaden | 83/305 |
| 5,375,492 | A | | 12/1994 | Smitterberg et al. | |
| 5,483,856 | A | | 1/1996 | Smitterberg et al. | |
| 5,488,887 | A | * | 2/1996 | Kitamura | B23D 19/08 241/101.4 |
| 5,660,095 | A | | 8/1997 | Smitterberg et al. | |
| 5,699,710 | A | * | 12/1997 | Creaden | 83/332 |
| 6,092,452 | A | * | 7/2000 | Adami | 83/428 |
| 7,044,040 | B1 | * | 5/2006 | Smith | 83/115 |
| 2011/0219924 | A1 | * | 9/2011 | Cummings | 83/39 |
| 2013/0288872 | A1 | * | 10/2013 | Knauer et al. | 493/324 |

* cited by examiner

CORRUGATED PAPERBOARD BOX MAKING MACHINE

TECHNICAL FIELD

The present invention relates to a corrugated paperboard box making machine configured to cut a single piece of large-size corrugated paperboard sheet to produce two small-size corrugated paperboard sheets. More specifically, the present invention relates to a corrugated paperboard box making machine which comprises a slotter for slotting a large-size corrugated paperboard sheet, and a cutting blade disposed downstream of the slotter and configured to cut the slotted large-size corrugated paperboard sheet into two small-size corrugated paperboard sheets.

BACKGROUND ART

Heretofore, there has been known a corrugated paperboard box making machine which comprises a slotter for slotting a large-size corrugated paperboard sheet, and a cutting device for cutting the slotted large-size corrugated paperboard sheet into two small-size corrugated paperboard sheets, as described, for example, in JP 2002-067190A (Patent Document 1). In the corrugated paperboard box making machine described in Patent Document 1, the slotter is operable to slot a large-size corrugated paperboard sheet to form slots, respectively, in downstream and upstream ends of the corrugated paperboard sheet in a conveyance direction (machine direction), and further form a slot in a central portion of the corrugated paperboard sheet. The cutting device described in the Patent Document 1 is disposed downstream of the slotter in the conveyance direction, and may be specifically composed of a box slitter described in JP 08-500297A (Patent Document 2). The box slitter is a special cutting device for cutting a stack obtained by stacking a plurality of folded and glued-on large-size corrugated paperboard sheets, into two sets each consisting of a stack of a plurality of small-size corrugated paperboard sheets.

A corrugated paperboard box making machine described in JP 02-089629A (Patent Document 3) comprises a creaser-slotter and a die-cutter. The die-cutter is disposed downstream of the creaser-slotter in a conveyance direction. The die-cutter comprises an anvil roll, and a blade-mounting cylinder configured to allow a cutting blade to be attached thereto. The blade is configured to cut a large-size corrugated paperboard sheet into two small-size corrugated paperboard sheets.

SUMMARY OF THE INVENTION

Technical Problem

In the corrugated paperboard box making machine described in the Patent Document 3, when a normal-size corrugated paperboard sheet is produced, a normal punching die suitable for punching to be performed for the corrugated paperboard sheet is attached to the blade-mounting cylinder. On the other hand, when a large-size corrugated paperboard sheet is cut to produce two small-size corrugated paperboard sheets, a punching die suitable for punching and cutting to be performed for the large-size corrugated paperboard sheet is attached to the blade-mounting cylinder. The punching die to be attached in this case is equipped with a cutting blade configured to cut the large-size corrugated paperboard sheet across its entire width in a direction perpendicular to the conveyance direction. During cutting, a large force is applied to the cutting blade, which gives rise to a need for firmly attaching the cutting blade-equipped punching die to the blade-mounting cylinder at a large number of positions. Thus, it is necessary to take a relatively long time during replacement between the normal punching die and the cutting blade-equipped punching die, i.e., for a replacement work for attaching or detaching the cutting blade-equipped punching die to the blade-mounting cylinder.

Furthermore, there is a need for a wide variety of corrugated paperboard sheets, which means that, in the case where various types of small-size corrugated paperboard sheets are produced, the frequency of order change also tends to increase. Thus, an increase in time required for the punching die replacement work becomes a major problem in achieving shortening of a preparation (setup) time before production of corrugated paperboard sheets.

It is therefore an object of the present invention to provide a corrugated paperboard box making machine capable of eliminating a need for the work of attaching or detaching a cutting blade for cutting a large-size corrugated paperboard sheet into two small-size corrugated paperboard sheets, and thereby quickly performing a preparatory work before production.

Solution to the Technical Problem

In order to achieve the above object, the present invention provides a corrugated paperboard box making machine which is configured to slot and punch a corrugated paperboard sheet conveyed along a given conveyance path. The corrugated paperboard box making machine comprises: a slotter for slotting a corrugated paperboard sheet to form slots, respectively, in downstream and upstream ends of the corrugated paperboard sheet in a conveyance direction; a die-cutter disposed downstream of the slotter, wherein the die-cutter includes a die cylinder to which a punching die is attached and an anvil cylinder; a cutting blade for cutting, in cooperation with the anvil cylinder of the die-cutter, a single piece of the corrugated paperboard sheet slotted by the slotter, into two small-size corrugated paperboard sheets, along a direction perpendicular to the conveyance direction; and a displacement mechanism for displacing the cutting blade in such a manner as to allow the cutting blade to be selectively set in one of a cutting position where the cutting blade is permitted to cut a corrugated paperboard sheet in the cooperation with the anvil cylinder, and a non-cutting position where the cutting blade is precluded from cutting a corrugated paperboard sheet.

In the above corrugated paperboard box making machine of the present invention, when the displacement mechanism operates to cause the cutting blade to be displaced and set in the cutting position, it becomes possible to use the cutting blade to cut the slotted large-size corrugated paperboard sheet into two small-size corrugated paperboard sheets, in cooperation with the anvil cylinder. On the other hand, when the displacement mechanism operates to cause the cutting blade to be displaced and set in the non-cutting position, it becomes possible to use the punching die attached to the die cylinder to punch a normal-size corrugated paperboard sheet, in cooperation with the anvil cylinder, while precluding the cutting blade from cutting any corrugated paperboard sheet. Therefore, in the present invention, the operation of cutting a large-size corrugated paperboard sheet into two small-size corrugated paperboard sheets can be performed only by displacing the cutting blade to the cutting position, so that it becomes possible to eliminate a need for the work of attaching or detaching the cutting blade with respect to the die cylinder, thereby quickly performing a preparatory work before production of the small-size corrugated paperboard sheets.

Preferably, in the corrugated paperboard box making machine of the present invention, the cutting blade is fixed to a rotary cylinder rotatable about an axis parallel to a rotational axis of the anvil cylinder; and the displacement mechanism is configured to displace the rotary cylinder having the cutting blade fixed thereto, in such a manner as to allow the cutting blade to be selectively set in one of a cutting position where the rotary cylinder is located in adjacent relation to the conveyance path and in opposed relation to the anvil cylinder across the conveyance path, and a non-cutting position where the rotary cylinder is located spaced apart from the conveyance path, and the die cylinder is located in opposed relation to the anvil cylinder across the conveyance path.

The corrugated paperboard box making machine having this feature makes it possible to readily perform switching between active and inactive states of the cutting blade by means of displacing the rotary cylinder closer to or away from the conveyance path, thereby shortening a switching time.

More preferably, the displacement mechanism comprises: a support frame supporting the rotary cylinder, the anvil cylinder and the die cylinder; and a driving device for displacing the support frame in an up-down direction.

The corrugated paperboard box making machine having this feature makes it possible to readily perform switching between active and inactive states of the cutting blade by means of displacing the support frame in the up-down direction, thereby further shortening a switching time. In addition, because the support frame is displaced in the up-down direction, the support frame can be disposed in adjacent relation to the slotter on the upstream side, which contributes to a reduction in size of the corrugated paperboard box making machine.

Alternatively, the anvil cylinder may be disposed at a fixed position with respect to the conveyance position, wherein the displacement mechanism may comprise a support member rotatably supporting the die cylinder and the rotary cylinder.

Preferably, in the corrugated paperboard box making machine of the present invention, the cutting blade is attached to the die cylinder, and configured such that it is precluded from cutting a corrugated paperboard sheet when the punching is performed using the punching die attached to the die cylinder.

More preferably, the cutting blade is attached to the die cylinder in such a manner as to be displaceable between a cutting position where the cutting blade is disposed to protrude from an outer peripheral surface of the die cylinder, and a non-cutting position where the cutting blade is retracted inside the die cylinder.

Alternatively, the cutting blade may be fixedly attached onto an outer peripheral surface of the die cylinder, and the anvil cylinder may have a recess formed in an outer peripheral surface of the die cylinder at a phase position corresponding to a phase of the cutting blade fixedly attached onto the outer peripheral surface of the die cylinder, and configured to allow a distal end of the cutting blade to be inserted thereinto.

DESCRIPTION OF EMBODIMENTS

First Embodiment

With reference to FIGS. 1 to 7, the present invention relating to a corrugated paperboard box making machine configured to process a corrugated paperboard sheet such as slotting and punching will now be described based on a first embodiment thereof. An up-down direction, a right-left direction and a front-rear direction are defined by the arrowed directions described in the figures.

<<General Configuration>>

Figure 1:
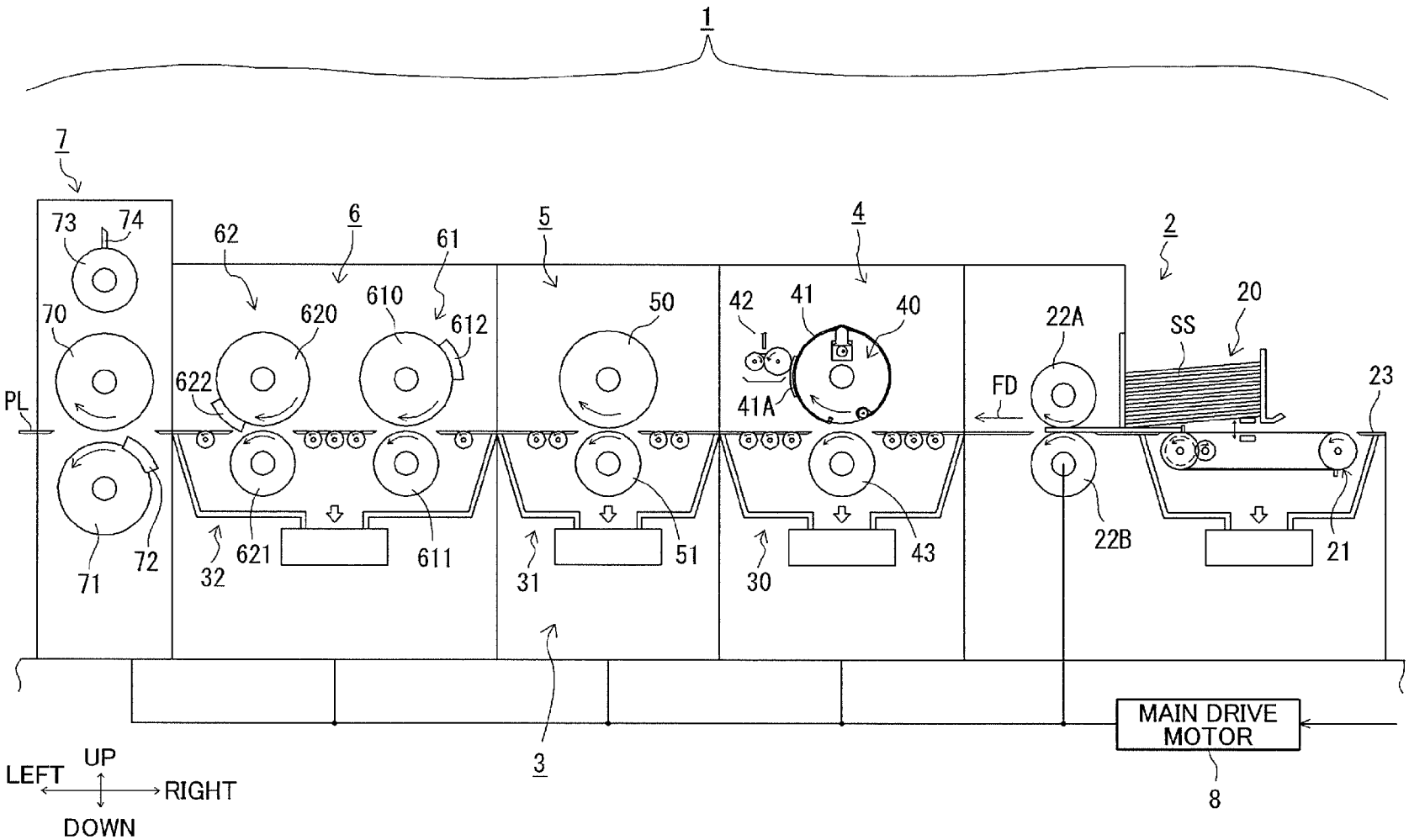
FIG. 1 is a front view illustrating a general configuration of a corrugated paperboard box making machine according to a first embodiment of the present invention.

FIG. 1 is a front view illustrating a general configuration of the corrugated paperboard box making machine 1 according to the first embodiment. The corrugated paperboard box making machine 1 comprises: a feeding apparatus 2 for feeding a plurality of corrugated paperboard sheets SS one-by-one toward a conveyance path PL; a conveyance apparatus 3 for conveying the corrugated paperboard sheet SS fed from the feeding apparatus 2, along the conveyance path PL; and a plurality of processing units arranged along the conveyance path PL to sequentially process the corrugated paperboard sheet SS. As the plurality of processing units, the corrugated paperboard box making machine 1 according to the first embodiment is provided with: a printer 4 for printing each of the corrugated paperboard sheets SS; a creaser 5 for forming, in the corrugated paperboard sheet SS, a crease extending in an aftermentioned conveyance direction; a slotter 6 for slotting the corrugated paperboard sheet SS: and a die-cutter 7 for punching the corrugated paperboard sheet SS.

<Configuration of Feeding Apparatus>

The feeding apparatus 2 comprises a hopper 20, a belt kicker mechanism 21, and a pair of feed rolls 22A, 22B. The set of feed rolls 22A, 22B are coupled to a main drive motor 8 via a heretofore-known driving force transmission mechanism in such a manner as to be rotated according to rotation of the main drive motor 8. The feeding apparatus 2 also comprises a sheet-feeding table 23 extending in a horizontal direction at the same height position as that of the conveyance path PL. Further, the feeding apparatus 2 comprises a suction chamber provided just below the belt kicker mechanism 21, and a suction blower connected to the suction chamber.

<Configuration of Conveyance Apparatus>

As illustrated in FIG. 1, the conveyance apparatus 3 comprises a printer conveyance section 30, a creaser conveyance section 31 and a slotter conveyance section 32. The conveyance sections 30 to 32 are arranged along the conveyance path PL to convey the corrugated paperboard sheet SS in a conveyance direction FD from right to left. Each of the conveyance sections 30 to 32 has the same fundamental configuration. Specifically, each of the conveyance sections comprises a large number of conveyance rollers arranged along the conveyance path PL, a suction chamber provided just below the conveyance rollers, and a suction blower connected to the suction chamber. The large number of conveyance rollers are coupled to the main drive motor 8 via a heretofore-known driving force transmission mechanism in such a manner as to be rotated according to rotation of the main drive motor 8.

<Configuration of Printer>

In the first embodiment, the printer 4 is composed of a heretofore-known flexographic printer. The printer 4 primarily comprises: a printing cylinder 40; a printing plate member 41 for making a print on the corrugated paperboard sheet SS; an ink applicator 42; and a press roll 43. The printing cylinder 40 is rotatably supported by a frame of the printer 4, and coupled to the main drive motor 8 via a heretofore-known driving force transmission mechanism in such a manner as to rotate in a direction indicated by the arrowed line in FIG. 1, according to rotation of the main drive motor 8. The press roll 43 is disposed at a position opposed to the printing cylinder 40 across the conveyance path PL, and coupled to the main drive motor 8 via a heretofore-known driving force transmission mechanism in such a manner as to be rotated in a direction indicated by the arrowed line in FIG. 1, according to rotation of the main drive motor 8. The press roll 43 is operable to clamp the corrugated paperboard sheet SS being conveyed, in cooperation with a printing plate 41A of the printing plate member 41 wrappingly attached to the printing cylinder 40, thereby perform desired printing. The printing plate member 41 is configured to be replaceable with a different printing plate member having a printing plate with a shape corresponding to a desired print pattern. The printing plate member 41 illustrated in FIG. 1 is configured as a type having only one printing plate 41A. On the other hand, the different printing plate member may be configured as a type having two printing plates, for example.

<Configuration of Creaser>

As illustrated in FIG. 1, the creaser 5 comprises an upper creaser roll 50 and a lower creaser roll 51 which are disposed across the conveyance path PL. The set of rolls 50, 51 are coupled to the main drive motor 8 via a heretofore-known driving force transmission mechanism in such a manner as to be rotated in respective directions indicated by the arrowed lines in FIG. 1 according to rotation of the main drive motor 8. The set of rolls 50, 51 are operable to form a crease extending in the conveyance direction FD, in the corrugated paperboard sheet SS being conveyed, at a desired position.

<Configuration of Slotter>

The slotter 6 is configured as a double slotter type comprising a first slotter sub-unit 61 and a second slotter sub-unit 62 which are disposed in upstream and downstream relation to each other along the conveyance path PL. The first slotter sub-unit 61 comprises a set of slotting slotter rolls which consist of a first upper slotter roll 610 and a first lower slotter roll 611 which are disposed across the conveyance path PL. The set of slotter rolls 610, 611 are coupled to the main drive motor 8 via a heretofore-known driving force transmission mechanism in such a manner as to be rotated in respective directions indicated by the arrowed lines in FIG. 1, according to rotation of the main drive motor 8. Similarly, the second slotter sub-unit 62 comprises a set of slotting slotter rolls which consist of a second upper slotter roll 620 and a second lower slotter roll 621 which are disposed across the conveyance path PL. The set of slotter rolls 620, 621 are coupled to the main drive motor 8 via a heretofore-known driving force transmission mechanism in such a manner as to be rotated in respective directions indicated by the arrowed lines in FIG. 1, according to rotation of the main drive motor 8. In an operation mode illustrated in FIG. 1, one slotter blade 612 is attached to the first upper slotter roll 610, and one slotter blade 622 is attached to the second upper slotter roll 620. In the case where it is necessary to additionally form a slot in the corrugated paperboard sheet SS at a central position in the conveyance direction FD, two slotter blades can be attached to each of the first upper slotter roll 610 and the second upper slotter roll 620.

<Schematic Configuration of Die-Cutter>

The die-cutter 7 is configured as a rotary type which comprises an anvil cylinder 70, and a die cylinder 71 disposed just below the anvil cylinder 70. A punching die 72 having a shape corresponding to a desired punched-out pattern is fixed to a wooden frame such as a veneer board. When it is necessary to perform punching, the wooden frame with the punching die 72 is wrappingly attached to an outer peripheral surface of the die cylinder 71. The punching die 72 is configured to form a punched-out pattern in the corrugated paperboard sheet SS being conveyed, at a desired position.

In the first embodiment, the die-cutter 7 further comprises a rotary cylinder 73 disposed just above the anvil cylinder 70. A cutting blade 74 is fixed to the rotary cylinder 73 in such a manner as to protrude from an outer peripheral surface of the rotary cylinder 73. The die-cutter 7 is configured to allow the rotary cylinder 73, the anvil cylinder 70 and the die cylinder 71 to be integrally lifted and lowered, i.e., integrally displaced in an up-down direction. Specifically, the die-cutter 7 is configured to allow the three cylinders 73, 70, 71 to be displaced in the up-down direction between a lifted position where the anvil cylinder 70 and the die cylinder 71 are disposed across the conveyance path PL, as illustrated in FIG. 1, and a lowered position where the rotary cylinder 73 and the anvil cylinder 70 are disposed across the conveyance path PL. A detailed configuration of the die-cutter 7 including a lifting-lowering mechanism for lifting and lowering the three cylinders will be described later.

<Types of Corrugated Paperboard Sheets>

Figure 2:
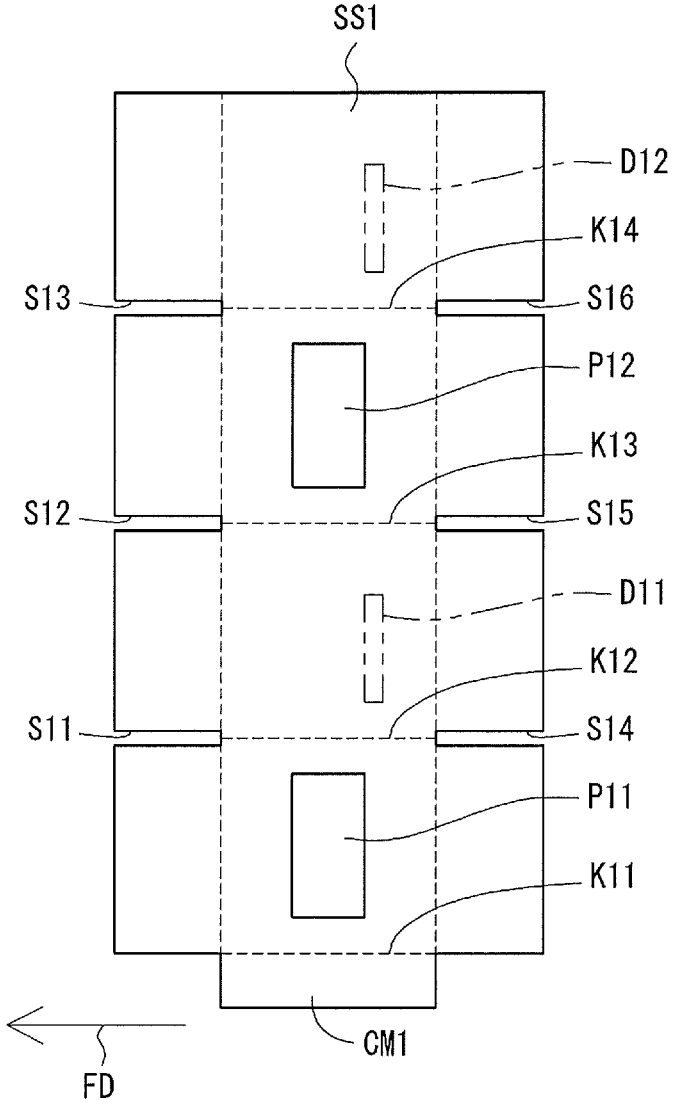
FIG. 2 is a plan view illustrating a normal sheet-length type corrugated paperboard sheet produced by the corrugated paperboard box making machine illustrated in FIG. 1.
Figure 3:
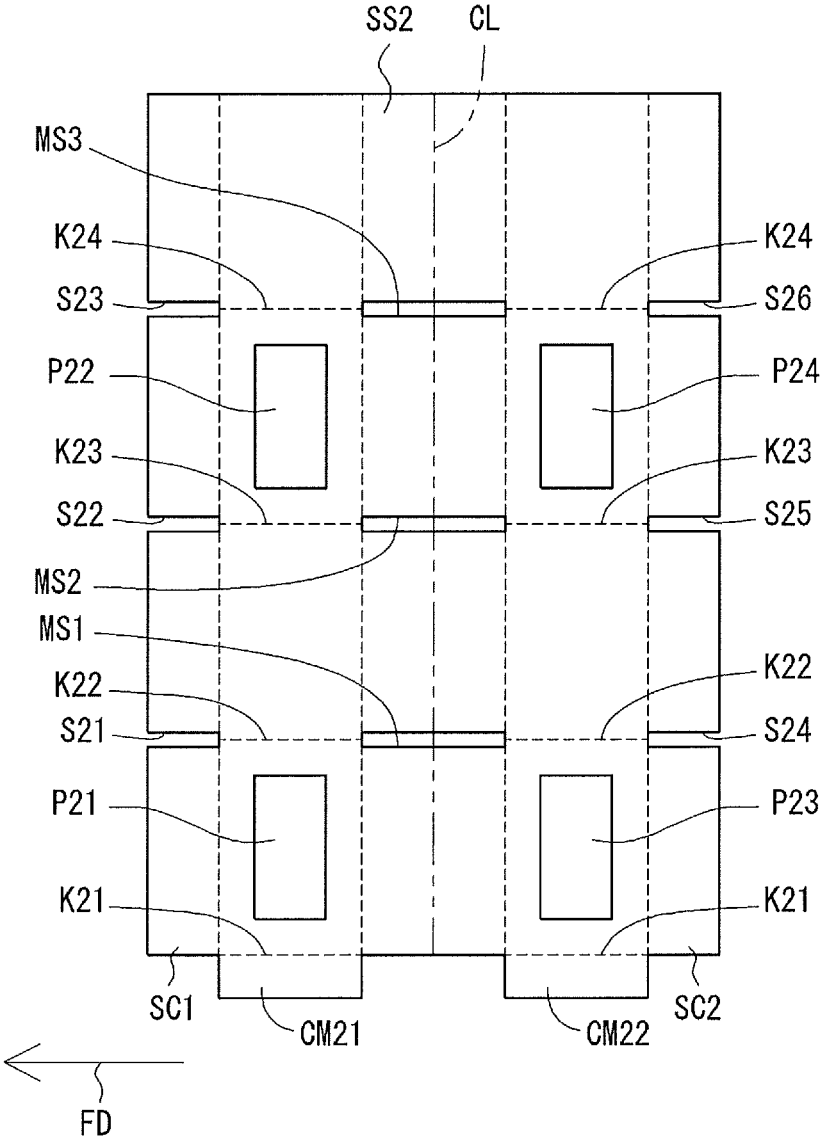
FIG. 3 is a plan view illustrating a long sheet-length type corrugated paperboard sheet to be used for producing two small-size corrugated paperboard sheets therefrom.

As for a corrugated paperboard sheet to be produced by the corrugated paperboard box making machine 1 according to the first embodiment, a sheet length thereof in the conveyance direction FD is set to various values depending on orders. As the sheet length becomes shorter, it becomes more difficult to accurately convey a corrugated paperboard sheet. For this reason, the corrugated paperboard box making machine 1 is configured to cut a single piece of corrugated paperboard sheet, after being printed, creased and slotted, into two small-size corrugated paperboard sheets. The corrugated paperboard sheet illustrated in FIG. 2 is a normal sheet-length type corrugated paperboard sheet SS1. The corrugated paperboard sheet illustrated in FIG. 3 is a long sheet-length type corrugated paperboard sheet SS2 for producing two small-size corrugated paperboard sheets SC1, SC2.

The corrugated paperboard sheet SS1 is in a processed state at the time it is discharged from the slotter 6 of the corrugated paperboard box making machine 1 illustrated in FIG. 1. Specifically, in the processed state, the corrugated paperboard sheet SS1 illustrated in FIG. 2 has: two print patterns P11, P12 made by the printing plate 41A of the printing plate member 41; four creases K11 to K14 formed by the creaser 5; three slots S11 to S13 formed by the slotter blade 622; and three slots S14 to S16 formed by the slotter blade 612. Further, the corrugated paperboard sheet SS1 has a joint flap CM1 formed by cutting off right and left corner portions thereof using a non-illustrated corner cutting blade attached to the first upper slotter roll 610 and a non-illustrated corner cutting blade attached to the second upper slotter roll 620. Then, when the corrugated paperboard sheet SS1 passes through between the anvil cylinder 70 and the die cylinder 71 set in the lifted position illustrated in FIG. 1, two punched-out patterns D11, D12 are formed by the punching die 72.

Figure 4:
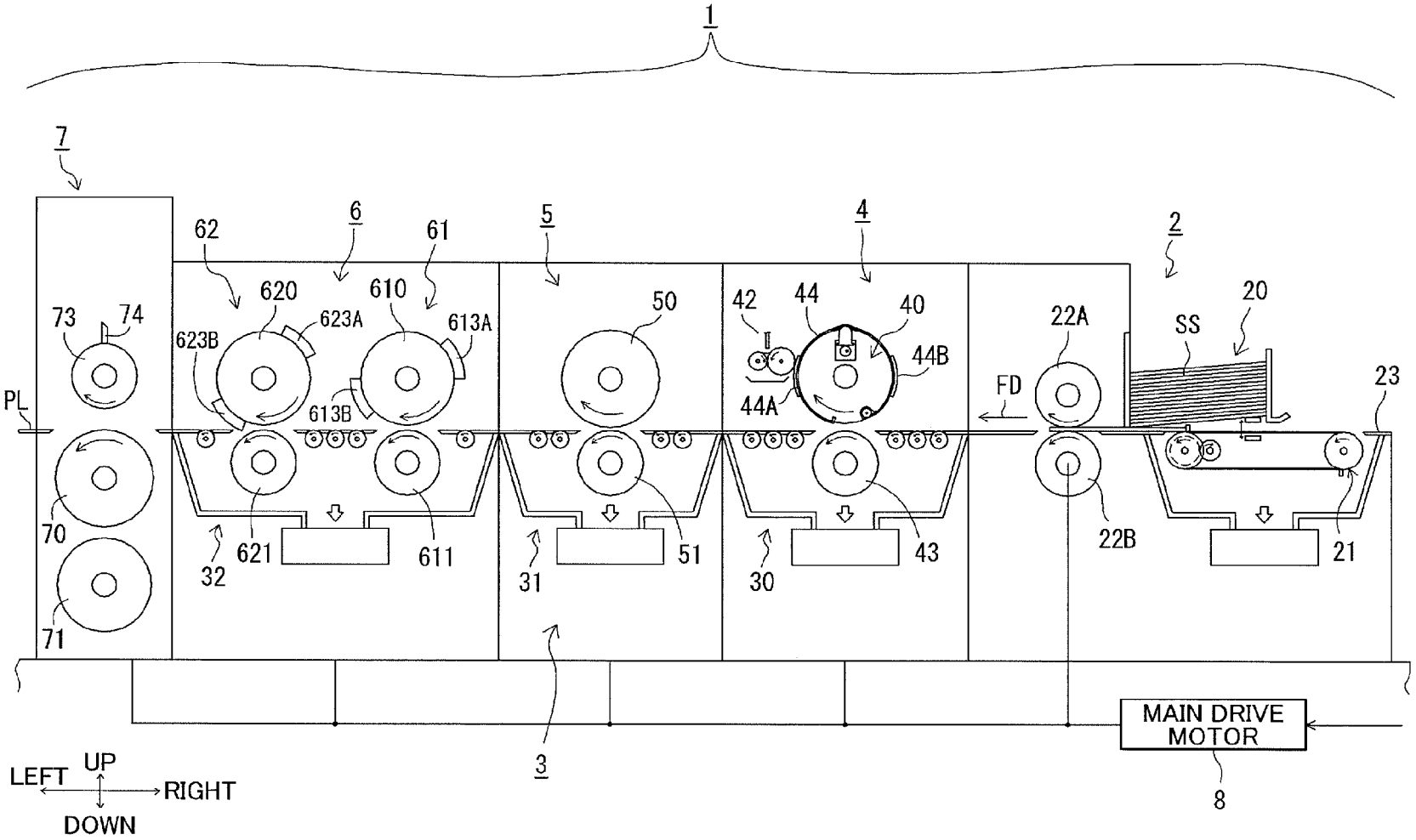
FIG. 4 is a front view illustrating the general configuration of the corrugated paperboard box making machine, wherein operating conditions, such as an installation state of processing members (e.g., a printing member and a slotter blade) for producing the corrugated paperboard sheet illustrated in FIG. 3, and a height position of three cylinders of a die-cutter, are changed from those in FIG. 1.

The corrugated paperboard sheet SS2 is in a processed state at the time it is discharged from the slotter 6 of the corrugated paperboard box making machine 1 illustrated in FIG. 4. In the corrugated paperboard box making machine 1 illustrated in FIG. 4, a different printing plate member 44 is wrappingly attached to the printing cylinder 40. The printing plate member 44 comprises two printing plates 44A, 44B. Two slotter blades 613A, 613B are attached to the first upper slotter roll 610, and two slotter blades 623A, 623B are attached to the second upper slotter roll 620. The three cylinders 73, 70, 71 are displaced downwardly to the lowered position where the rotary cylinder 73 and the anvil cylinder 70 are disposed across the conveyance path PL. In the above processed state, the corrugated paperboard sheet SS2 illustrated in FIG. 3 has: two print patterns P21, P22 made by the printing plate 44A of the printing plate member 44; two print patterns P23, P24 made by the printing plate 44B of the printing plate member 44; four creases K21 to K24 formed by the creaser 5; three slots S21 to S23 formed by the slotter blade 623A; three central slots MS1 to MS3 each having a left half formed by the slotter blade 623B and a left half formed by the slotter blade 613A; and three slots S24 to S26 formed by the slotter blade 613B. Further, the corrugated paperboard sheet SS2 has: a joint flap CM21 formed by cutting off a left corner portion and a left half of a central region of one side portion thereof using non-illustrated two corner cutting blades attached to the second upper slotter roll 620; and a joint flap CM22 formed by cutting off a right corner portion and a right half of the central region of the one side portion thereof using non-illustrated two corner cutting blades attached to the first upper slotter roll 610. Then, when the corrugated paperboard sheet SS2 passes through between the rotary cylinder 73 and the anvil cylinder 70 set in the lowered position illustrated in FIG. 4, a central cut line CL is formed by the cutting blade 74, so that the corrugated paperboard sheet SS2 is cut into two small-size corrugated paperboard sheets SC1, SC2. Each of the two corrugated paperboard sheets SC1, SC2 has the same shape and size.

<Detailed Configuration of Die-Cutter>

Figure 5:
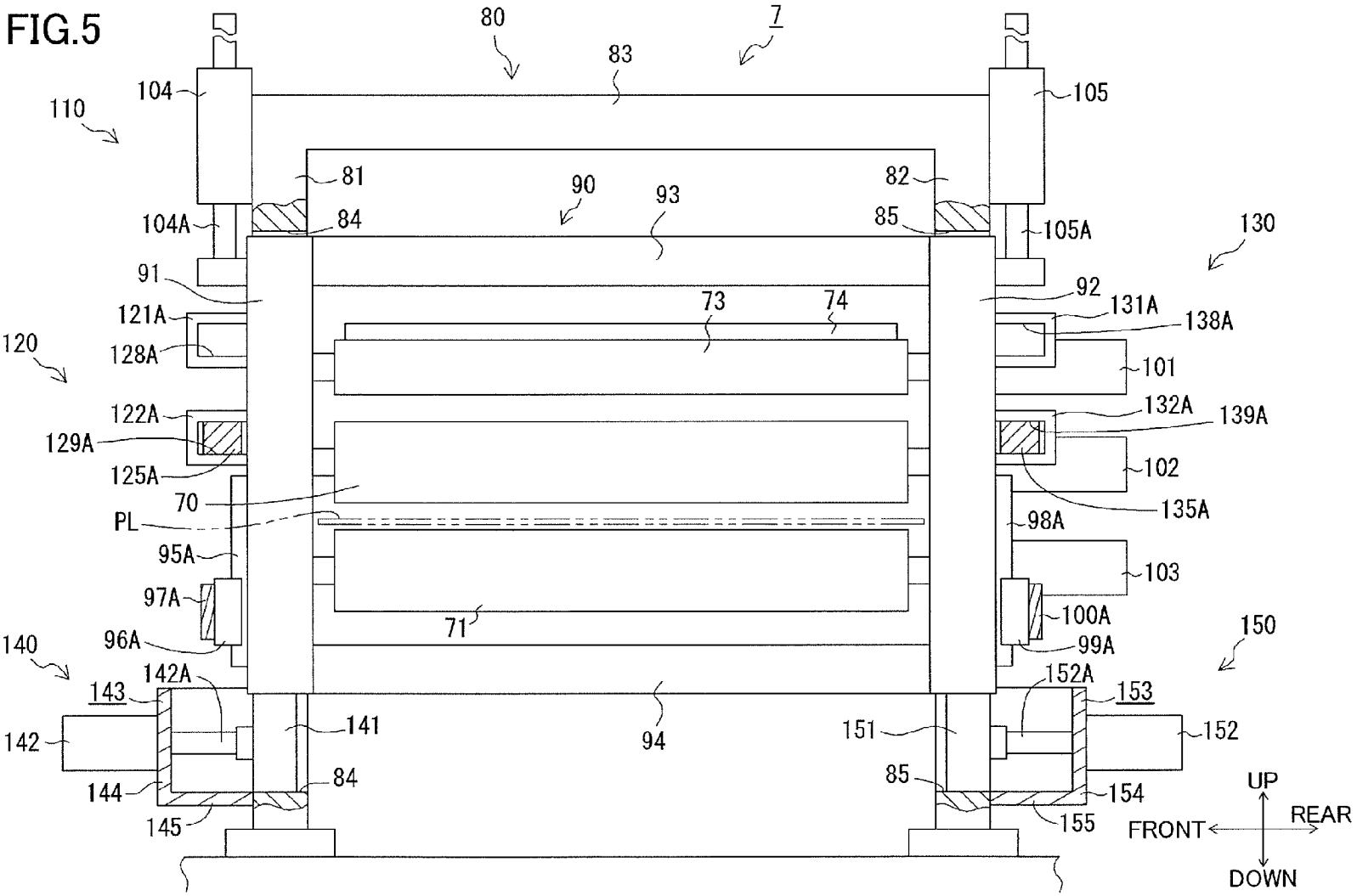
FIG. 5 is a partially broken-out, right side view illustrating the die-cutter.
Figure 6:
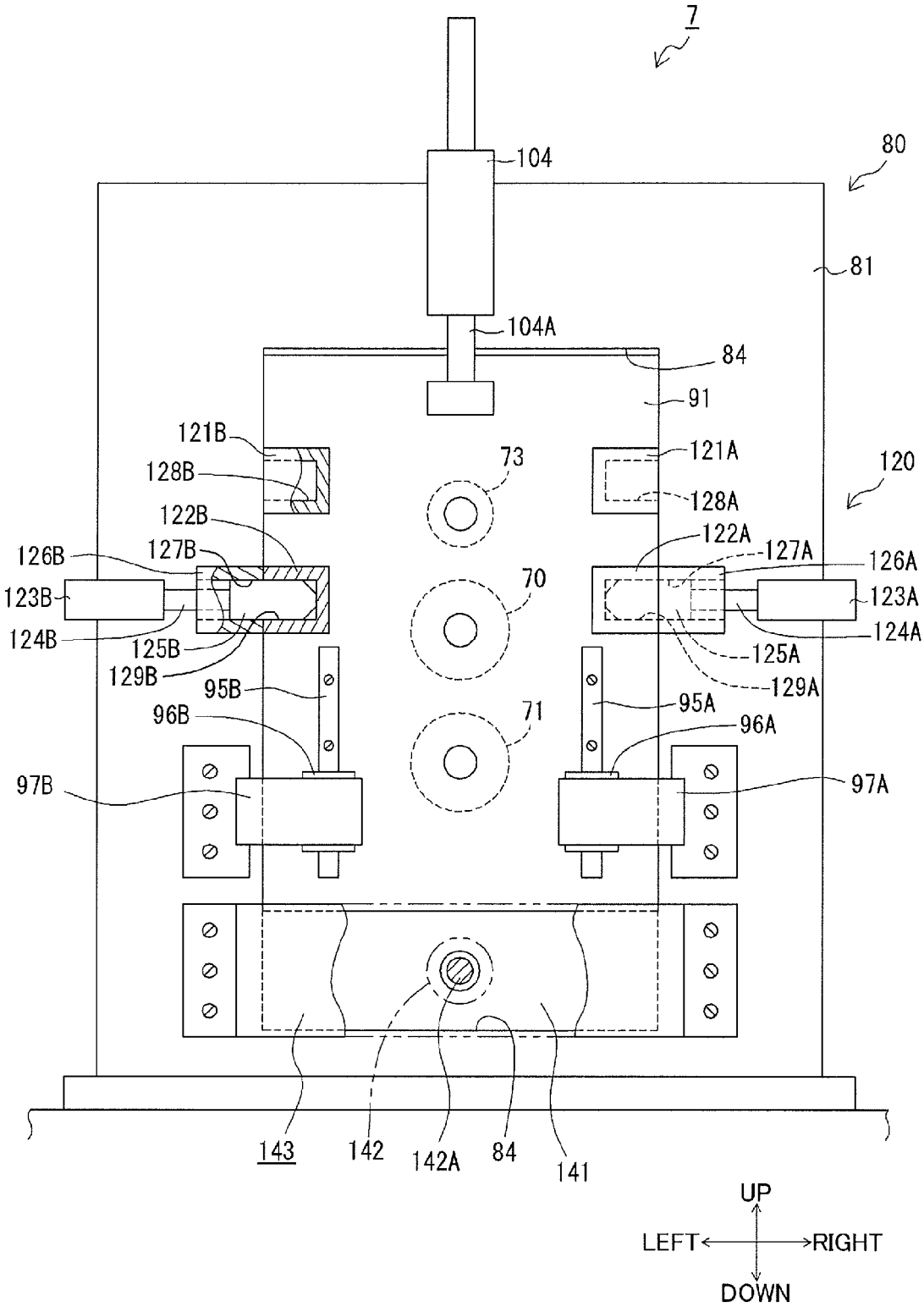
FIG. 6 is a partially broken-out, front view illustrating the die-cutter.

With reference to FIGS. 5 and 6, the detailed configuration of the die-cutter will be described. FIG. 5 is a partially broken-out, right side view illustrating the die-cutter 7, and FIG. 6 is a partially broken-out, front view illustrating the die-cutter 7.

The die-cutter 7 comprises a stationary frame 80, and a movable frame 90. The stationary frame 80 comprises a front leg portion 81, a rear leg portion 82, and a beam portion 83 extending between respective upper ends of the two leg portions. The front leg portion 81 and the rear leg portion 82 are formed, respectively, with a front guide groove 84 and a rear guide groove 85 each extending in the up-down direction. The movable frame 90 comprises: a front wall portion 91; a rear wall portion 92; an upper and lower beam portions 93, 94 each extending between a respective one of a set of upper ends and a set of lower ends of the two wall portions. The front wall portion 91 and the rear wall portion 92 are guided in the up-down direction, respectively, by the front guide groove 84 and the rear guide groove 85, while being fitted thereinto.

As illustrated in FIG. 6, a pair of front guide rails 95A, 95B are fixed to a lower region of the front wall portion 91 to extend in the up-down direction. A pair of front guide bearings 96A, 96B are engaged, respectively, with the pair of front guide rails 95A, 95B. The pair of front guide bearings 96A, 96B are fixed to the front leg portion 81, respectively, through a pair of fixing brackets 97A, 97B. Based on the engagement between corresponding ones of the front guide rails 95A, 95B and the front guide bearings 96A, 96B, the front wall portion 91 is guided in the up-down direction while being located within the front guide groove 84. Similarly, a pair of rear guide rails are fixed to a lower region of the rear wall portion 92 to extend in the up-down direction. A pair of rear guide bearings are engaged, respectively, with the pair of rear guide rails. The pair of rear guide bearings are fixed to the rear leg portion 82, respectively, through a pair of fixing brackets. In FIG. 5, one 98A of the rear guide rails, one 99A of the rear guide bearings and one 100A of the fixing brackets are illustrated. Based on the engagement between corresponding ones of the rear guide rails and the rear guide bearings, the rear wall portion 92 is guided in the up-down direction while being located within the rear guide groove 85.

A rotary shaft of the rotary cylinder 73, a rotary shaft of the anvil cylinder 70 and a rotary shaft of the die cylinder 71 are rotatably supported by the front wall portion 91 and the rear wall portion 92. A rotary-cylinder motor 101, an anvil-cylinder motor 102 and a die-cylinder motor 103 are fixed to the rear wall portion 92, and coupled, respectively, to the rotary shafts of the cylinders 73, 70, 71.

A pair of oil hydraulic cylinders 104, 105 are fixed, respectively, to the upper ends of the front leg portion 81 and the rear leg portion 82. The oil hydraulic cylinders 104, 105 are provided, respectively with piston rods 104A, 105A each having a lower end fixed to an upper end of a respective one of the front wall portion 91 and the rear wall portion 92. Upon driving of the oil hydraulic cylinders 104, 105, the movable frame 90 is displaced in the up-down direction. In the first embodiment, a lifting-lowering mechanism for lifting and lowering the three cylinders 73, 70, 71 is made up of the oil hydraulic cylinders 104, 105, the movable frame 90, the front and rear guide rails 95A, 98A, the front and rear guide bearings 96A, 99A and others. FIG. 5 illustrates a state in which the three cylinders 73, 70, 71 are set in the lifted position where the anvil cylinder 70 and the die cylinder 71 are disposed across the conveyance path PL.

(Configuration of Clamp Mechanism)

In the first embodiment, a front clamp mechanism 120 and a rear clamp mechanism 130 are provided to allow the movable frame 90 supporting the three cylinders 73, 70, 71 to be retained in the lifted position or the lowered position. The front clamp mechanism 120 primarily comprises a pair of upper lockable members 121A, 121B, a pair of lower lockable members 122A, 122B, and a pair of air cylinders 123A, 123B. The upper and lower lockable members 121A, 122A are fixedly mounted in a right end of the front wall portion 91, and the upper and lower lockable members 121B, 122B are fixedly mounted in a left end of the front wall portion 91. The air cylinders 123A, 123B are fixed, respectively, to right and left ends of the front leg portion 81, and provided, respectively, with piston rods 124A, 124B. Each of the piston rods 124A, 124B is displaceable in a right-left direction. A pair of retaining members 125A, 125B are fixed, respectively, to distal ends of the piston rods 124A, 124B. A pair of guide members 126A, 126B are fixedly mounted in the front leg portion 81 at positions adjacent to respective right and left edges of the front guide groove 84 of the front leg portion 81. The guide members 126A, 126B are formed, respectively, with through-holes 127A, 127B each capable of guiding a respective one of the retaining members 125A, 125B in the right-left direction.

The lockable members 121A, 122A are formed, respectively, with retention grooves 128A, 129A opened rightwardly. The lockable members 121B, 122B are formed, respectively, with retention grooves 128B, 129B opened leftwardly. When the movable frame 90 supporting the three cylinders 73, 70, 71 is set in the lifted position illustrated in FIG. 6, the through-holes 127A, 127B of the guide members 126A, 126B are aligned with the retention grooves 129A, 129B of the lower lockable members 122A, 122B. In this state, when the air cylinders 123A, 123B are driven, the retaining members 125A, 125B can be fitted, respectively, into the retention grooves 129A, 129B. Based on this fitting, the movable frame 90 is retained in the lifted position. On the other hand, when the movable frame 90 is set in the lowered position, the through-holes 127A, 127B of the guide members 126A, 126B are aligned with the retention grooves 128A, 128B of the upper lockable members 121A, 121B. In this state, when the air cylinders 123A, 123B are driven, the retaining members 125A, 125B can be fitted, respectively, into the retention grooves 128A, 128B. Based on this fitting, the movable frame 90 is retained in the lowered position.

The rear clamp mechanism 130 has a configuration similar to that of the front clamp mechanism 120, and primarily comprises a pair of upper lockable members, a pair of lower lockable members, and a pair of air cylinders 133A, 133B. The four lockable members of the rear clamp mechanism 130 are fixedly mounted in the rear wall portion 92, individually. The air cylinders 133A, 133B are fixed to the rear leg portion 82, individually. FIG. 5 illustrates only one 131A of the upper lockable members, a retention groove 138A of the upper lockable member 131A, one 132A of the lower lockable members, a retention groove 139A of the lower lockable member 132A, and one 135A of a pair of retaining members.

(Configuration of Support Mechanism)

In the first embodiment, a front support mechanism 140 and a rear support mechanism 150 are provided to support the movable frame 90 supporting the three cylinders 73, 70, 71. The front support mechanism 140 primarily comprises a support member 141, an air cylinder 142, and a support frame 143. The support frame 143 is fixed at right and left ends thereof to the front leg portion 81, while extending across the front guide groove 84 of the front leg portion 81 in the right-left direction. As illustrated in FIG. 5, the support frame 143 has an L shape in cross-sectional, and comprises an upstanding wall portion 144 and a horizontal guide portion 145. The air cylinder 142 is fixed to the upstanding wall portion 144, and provided with a piston rod 142A. The support member 141 is fixed to a distal end of the piston rod 142A. As illustrated in FIG. 6, the support member 141 has a rectangular shape which is long in the right-left direction, and capable of entering into a lower space defined between a lower end of the movable frame 90 set in the lifted position and a lower end of the front guide groove 84. FIG. 5 illustrates a state in which the support member 141 is displaced to enter the lower space and supports the movable frame 90 from therebelow. The horizontal guide portion 145 is configured to, when the piston rod 142A is displaced in the right-left direction, guide the support member 141 in the right-left direction, while being kept in contact with a lower end surface of the support member 141.

The rear support mechanism 150 has a configuration similar to that of the front support mechanism 140, and primarily comprises a support member 151, an air cylinder 152, and a support frame 153. The support frame 153 is fixed at right and left ends thereof to the rear leg portion 82, while extending across the rear guide groove 85 of the rear leg portion 82 in the right-left direction. As illustrated in FIG. 5, the support frame 153 has an L shape in cross-sectional, and comprises an upstanding wall portion 154 and a horizontal guide portion 155. The air cylinder 152 is fixed to the upstanding wall portion 154, and provided with a piston rod 152A. The support member 151 is fixed to a distal end of the piston rod 152A. FIG. 5 illustrates a state in which the support member 151 is displaced to enter a lower space defined between the lower end of the movable frame 90 set in the lifted position and the lower end of the rear guide groove 85, and supports the movable frame 90 from therebelow. The horizontal guide portion 155 is configured to, when the piston rod 152A is displaced in the right-left direction, guide the support member 151 in the right-left direction, while being kept in contact with a lower end surface of the support member 151.

<<Electrical Configuration>>

Figure 7:
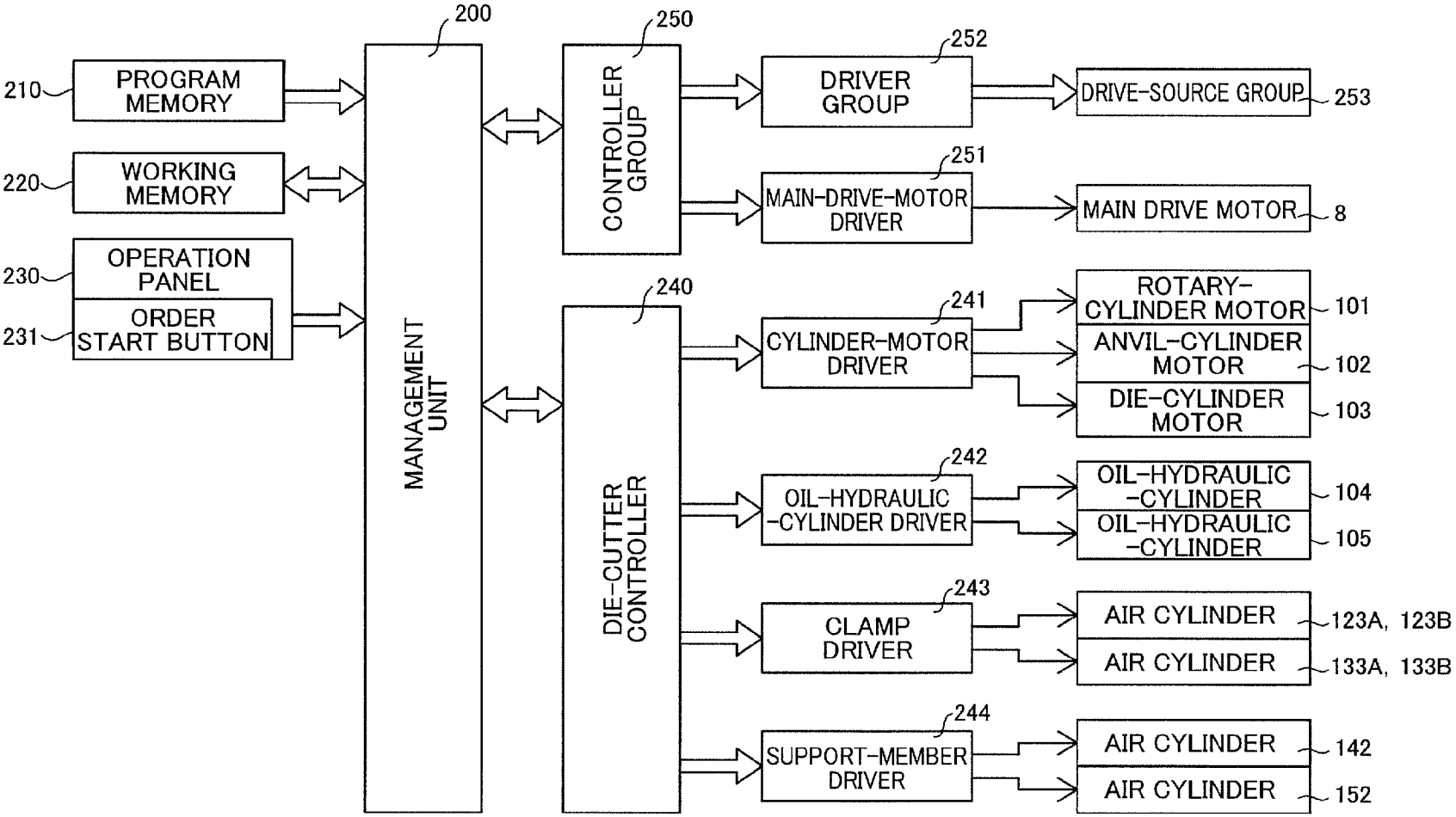
FIG. 7 is a block diagram illustrating an electrical configuration of the corrugated paperboard box making machine.

With reference to FIG. 7, an electrical configuration of the corrugated paperboard box making machine 1 according to the first embodiment will be described below. FIG. 7 is a block diagram illustrating an electrical configuration of the corrugated paperboard box making machine 1 according to the first embodiment. As illustrated in FIG. 7, the corrugated paperboard box making machine 1 comprises a management unit 200 for generally managing processings of a corrugated paperboard sheet. The management unit 200 is operable, according to a predetermined processing management plan regarding a large number of orders, to read, from a program memory 210, control instruction information, such as a motor speed of the main drive motor 8, and a size and a required number of corrugated paperboard sheets.

Then, the management unit 200 is operable, according to the read control instruction information, to provide instructions for controlling drive sources such as the main drive motor, and servomotors of various processing units, and count the number of corrugated paperboard sheets regarding each order, thereby performing production management. The management unit 200 is configured to provide instructions for controlling all drive sources equipped in the corrugated paperboard box making machine 1. However, among such drive sources, only a configuration for controlling drive sources of the die-cutter 7 directly associated with the present invention is illustrated in FIG. 7 in detail. A configuration for controlling drive sources of the printer 4, the creaser 5 and the slotter 6, other than the die-cutter 7, has heretofore been known as disclosed, for example, in the Patent Document 1. Thus, it will be briefly described.

The program memory 210 is configured to fixedly store therein programs such as a main control routine for the management unit 200, and a control routine for generally controlling the die-cutter 7, and further fixedly store therein various set values. A working memory 220 is provided to temporarily store therein a result of arithmetic processing by the management unit 200. An operation panel 230 is connected to the management unit 200. The operation panel 230 has an order start button 231. The order start button 231 is a button capable of allowing an operator to be manually operated to start one order.

The management unit 200 is operable to send control instruction information to a die-cutter controller 240, and a controller group 250 for controlling processing units other than the die-cutter 7. The die-cutter controller 240 is operable, according to the control instruction information, to control operations of a cylinder-motor driver 241, an oil-hydraulic-cylinder driver 242, a clamp driver 243, and a support-member driver 244. The cylinder-motor driver 241 is operable to drive each of the rotary-cylinder motor 101, the anvil-cylinder motor 102 and the die-cylinder motor 103 in a rotational direction and at a motor speed according to the control instruction information, or stop the drive according to the control instruction information. More specifically, when the three cylinders 73, 70, 71 is set in the lifted position illustrated in FIG. 1, the cylinder-motor driver 241 is operable to stop the drive of the rotary-cylinder motor 101, and rotate the anvil-cylinder motor 102 and the die-cylinder motor 103 in the respective directions indicated by the arrowed lines in FIG. 1 and at a motor speed according to the control instruction information. On the other hand, when the three cylinders 73, 70, 71 is set in the lowered position illustrated in FIG. 4, the cylinder-motor driver 241 is operable to stop the drive of the die-cylinder motor 103, and rotate each of the rotary-cylinder motor 101 and the anvil-cylinder motor 102 in the direction indicated by the arrowed line in FIG. 4 and at a motor speed according to the control instruction information.

The oil-hydraulic-cylinder driver 242 is operable, according to the control instruction information, to change an oil pressure to be given to each of the oil hydraulic cylinders 104, 105. More specifically, during a period in which the three cylinders 73, 70, 71 is set in the lifted position illustrated in FIG. 1, the oil-hydraulic-cylinder driver 242 is operable to change the oil pressure to allow the piston rods 104A, 105A of the oil hydraulic cylinders 104, 105 to be retracted as illustrated in FIG. 5. On the other hand, during a period in which the three cylinders 73, 70, 71 is set in the lowered position illustrated, the oil-hydraulic-cylinder driver 242 is operable to change the oil pressure to allow the piston rods 104A, 105A of the oil hydraulic cylinders 104, 105 to protrude downwardly.

The clamp driver 243 is operable, according to the control instruction information, to change an air pressure to be given to each of the air cylinders 123A, 123B and the air cylinders 133A, 133B. More specifically, during a period in which the movable frame 90 supporting the three cylinders 73, 70, 71 is set in the lifted position or the lowered position, the clamp driver 243 is operable to change the air pressure to allow each of the piston rods of the air cylinders 123A, 123B and the air cylinders 133A, 133B to be extended. On the other hand, during a period in which the movable frame 90 is being lifted or lowered between the lifted position and the lowered position, the clamp driver 243 is operable to change the air pressure to allow each of the piston rods of the air cylinders 123A, 123B and the air cylinders 133A, 133B to be retracted.

The support-member driver 244 is operable, according to the control instruction information, to change an air pressure to be given to the air cylinders 142, 152. More specifically, during the period in which the movable frame 90 is set in the lifted position illustrated in FIG. 5, the support-member driver 244 is operable to change the air pressure to allow each of the piston rods 142A, 152A of the air cylinders 142, 152 to be extended. On the other hand, during the period in which the movable frame 90 is being lifted or lowered between the lifted position and the lowered position, the support-member driver 244 is operable to change the air pressure to allow each of the piston rods 142A, 152A of the air cylinders 142, 152 to be retracted.

The controller group 250 is operable, according to the control instruction information, to control operations of the main-drive-motor driver 251 and the driver group 252. The main-drive-motor driver 251 is operable to drive the main drive motor 8 at a motor speed according to the control instruction information, or stop the drive according to the control instruction information. The driver group 252 is operable to drive a drive-source group 253 for the feeding apparatus 2, the printer 4, the creaser 5 and the slotter 6, other than the die-cutter 7, or stop the drive. The drive source group 253 includes: a servomotor for positioning the upper creaser roll 50 and the lower creaser roll 51 of the creaser 5 in the front-rear direction; a servomotor for positioning the first upper slotter roll 610 and the first lower slotter roll 611 in the front-rear direction; a servomotor for positioning the second upper slotter roll 620 and the second lower slotter roll 621 in the front-rear direction; and a servomotor for adjusting a rotational phase of each of the printing cylinder 40, the first upper slotter roll 610 and the second upper slotter roll 620, with respect to a timing of feeding the corrugated paperboard sheet SS by the feeding apparatus 2.

<<Operation and Functions of First Embodiment>>

An operation and functions of the corrugated paperboard box making machine 1 according to the first embodiment will be described below. The corrugated paperboard box making machine 1 implements an order of producing the normal sheet-length type corrugated paperboard sheet SS1 illustrated in FIG. 2, and an order of producing the short sheet-length type small-size corrugated paperboard sheets SC1, SC2 illustrated in FIG. 3.

<Production of Normal Sheet-Length Type Corrugated Paperboard Sheet SS1>

In advance of start of production of the normal sheet-length type corrugated paperboard sheet SS1, an operator wrappingly attaches the printing plate member 41 suitable for the production of the corrugated paperboard sheet SS1, to the printing cylinder 40, and attaches the slotter blade 612 and the slotter blade 622 suitable for the production of the corrugated paperboard sheet SS1, respectively, to the first upper slotter roll 610 and the second upper slotter roll 620. Further, an operator attaches a wooden frame to which a punching die 72 suitable for the production of the corrugated paperboard sheet SS1 is fixed, to the die cylinder by a screw or the like.

In response to an operator's manual operation of the order start button 231 of the operation panel 230 in order to start the production of the normal sheet-length type corrugated paperboard sheet SS1, the management unit 200 sequentially reads control instruction information for producing the normal sheet-length type corrugated paperboard sheet SS1, from the program memory 210, and sends the control instruction information to the die-cutter controller 240 and the controller group 250. The die-cutter controller 240 controls the oil-hydraulic-cylinder driver 242 to cause the piston rods 104A, 105A of the oil hydraulic cylinders 104, 105 to be retracted to thereby lift the movable frame 90 to the lifted position. When the movable frame 90 reaches the lifted position, the die-cutter controller 240 controls the support-member driver 244 to cause the support members 141, 151 to enter the lower space defined below the lower end of the movable frame 90. When the support members 141, 151 completely enters the lower space, the die-cutter controller 240 controls the oil-hydraulic-cylinder driver 242 to drive the oil hydraulic cylinders 104, 105 in a direction causing the piston rods 104A, 105A to protrude downwardly in order to allow the lower end the movable frame 90 to reliably come into contact with the piston rods 104A, 105A.

After the lower end the movable frame 90 comes into contact with the piston rods 104A, 105A, the die-cutter controller 240 controls the clamp driver 243 to cause the piston rods of the air cylinders 123A, 123B, 133A, 133B to be extended. As a result of this control, the retaining members (incl. 125A, 125B, 135A) are fitted into corresponding ones of the retention grooves (incl. 129A, 129B, 139A), so that the movable frame 90 is retained in the lifted position. In the lifted position, the anvil cylinder 70 and the die cylinder 71 are positioned in such a manner as to be disposed in opposed relation to each other across the conveyance path PL, as illustrated in FIG. 1.

After completion of positioning of the anvil cylinder 70 and the die cylinder 71, the management unit 200 instructs the controller group 250 to drive the main drive motor 8 and the drive-source group 253. The controller group 250 controls the main-drive-motor driver 251 to cause the main drive motor 8 to rotate at a motor speed suitable for the production of the corrugated paperboard sheet SS1, and controls the driver group 252 in order to perform the sheet feeding, the printing, the creasing, the slotting and others. The management unit 200 also instructs the die-cutter controller 240 to drive the anvil-cylinder motor 102 and the die-cylinder motor 103 in order to produce the normal sheet-length type corrugated paperboard sheet SS1. The die-cutter controller 240 controls the cylinder-motor driver 241 to cause the anvil cylinder 70 and the die cylinder 71 to rotate in the respective directions indicated by the arrowed lines in FIG. 1 and at a motor speed coincident with a corrugated paperboard sheet conveyance speed to be determined by a motor speed of the main drive motor 8. The die-cutter controller 240 also controls the cylinder-motor driver 241 to cause the rotary cylinder 73 to be maintained in a stopped state.

Along with rotation of the main drive motor 8, corrugated paperboard sheets SS are fed from the feeding apparatus 2 one-by-one, and each of the corrugated paperboard sheets SS is printed, creased, slotted and corner-cut. The corrugated paperboard sheet SS1 after being processed is discharged from the slotter 6. The die-cutter 7 operates to punch the corrugated paperboard sheet SS1 to form the punched-out patterns D11, D12. The above series of processings will be repeatedly performed plural times corresponding to a required sheet number determined according to the order of producing the normal sheet-length type corrugated paperboard sheet SS1. When the corrugated paperboard sheet SS1 is produced in the required number, the drive of the main drive motor 8, the anvil-cylinder motor 102 and the die-cylinder motor 103 is stopped.

<Production of Short Sheet-Length Type Small-Size Corrugated Paperboard Sheet SS1>

In advance of start of production of the short sheet-length type small-size corrugated paperboard sheets SC1, SC2, an operator wrappingly attaches the printing plate member 44 suitable for the production of the small-size corrugated paperboard sheets SC1, SC2, to the printing cylinder 40, and attaches the set of slotter blades 613A, 613B and the set of slotter blades 623A, 623B suitable for the production of the small-size corrugated paperboard sheets SC1, SC2, respectively, to the first upper slotter roll 610 and the second upper slotter roll 620. In the first embodiment, during the production of the small-size corrugated paperboard sheets SC1, SC2, the wooden frame having the punching die 72 fixed thereto is detached from the die cylinder 71.

In response to an operator's manual operation of the order start button 231 of the operation panel 230 in order to start the production of the small-size corrugated paperboard sheets SC1, SC2, the management unit 200 sequentially reads control instruction information for producing the small-size corrugated paperboard sheets SC1, SC2, from the program memory 210, and sends the control instruction information to the die-cutter controller 240 and the controller group 250. The die-cutter controller 240 controls the clamp driver 243 to cause the piston rods of the air cylinders 123A, 123B, 133A, 133B to be retracted. As a result of this control, the retaining members (incl. 125A, 125B, 135A) are pulled out of corresponding ones of the retention grooves (incl. 129A, 129B, 139A), so that the retention of the movable frame 90 by the clamp mechanisms 120, 130 is released.

The die-cutter controller 240 controls the oil-hydraulic-cylinder driver 242 to drive the oil hydraulic cylinders 104, 105 in a direction causing the piston rods 104A, 105A to be retracted, in order to release the contact between the lower end of the movable frame 90 and each of the support members 141, 151. Then, the die-cutter controller 240 controls the support-member driver 244 to cause the support members 141, 151 to move out of the lower space defined below the lower end of the movable frame 90. When the support members 141, 151 completely moves out of the lower space, the die-cutter controller 240 controls the oil-hydraulic-cylinder driver 242 to cause the piston rods 104A, 105A of the oil hydraulic cylinders 104, 105 to protrude downwardly in such a manner as to gradually lower the movable frame 90 to the lowered position. When the lower end the movable frame 90 comes into contact with lower end surfaces of the front guide groove 84 and the rear guide groove 85 of the stationary frame 80, i.e., the movable frame 90 reaches the lowered position, the die-cutter controller 240 controls the clamp driver 243 to cause the piston rods of the air cylinders 123A, 123B, 133A, 133B to be extended. As a result of this control, the retaining members (incl. 125A, 125B, 135A) are fitted into corresponding ones of the retention grooves (incl. 128A, 128B, 138A), so that the movable frame 90 is retained in the lowered position. In the lowered position, the rotary cylinder 73 and the anvil cylinder 70 are positioned in such a manner as to be disposed in opposed relation to each other across the conveyance path PL, as illustrated in FIG. 4.

After completion of positioning of the rotary cylinder 73 and the anvil cylinder 70, the management unit 200 instructs the controller group 250 to drive the main drive motor 8 and the drive-source group 253. The controller group 250 controls the main-drive-motor driver 251 to cause the main drive motor 8 to rotate at a motor speed suitable for the production of the small-size corrugated paperboard sheets SC1, SC2, and controls the driver group 252 in order to perform the sheet feeding, the printing, the creasing, the slotting and others. The management unit 200 also instructs the die-cutter controller 240 to drive the rotary-cylinder motor 101 and the anvil-cylinder motor 102 in order to the small-size corrugated paperboard sheets SC1, SC2. The die-cutter controller 240 controls the cylinder-motor driver 241 to cause the rotary cylinder 73 and the anvil cylinder 70 to rotate in the respective directions indicated by the arrowed lines in FIG. 4 and at a motor speed coincident with the corrugated paperboard sheet conveyance speed to be determined by the motor speed of the main drive motor 8. The die-cutter controller 240 also controls the cylinder-motor driver 241 to cause the die cylinder 71 to be maintained in a stopped state.

Along with rotation of the main drive motor 8, corrugated paperboard sheets SS are fed from the feeding apparatus 2 one-by-one, and each of the corrugated paperboard sheets SS is printed, creased, slotted for forming the central slots MS1 to MS3, and corner-cut. The corrugated paperboard sheet SS2 after being processed is discharged from the slotter 6. The die-cutter 7 operates to cut the corrugated paperboard sheet SS2 in accordance with the central cut line CL. The above series of processings will be repeatedly performed plural times corresponding to one-half of a required sheet number determined according to the order of producing the small-size corrugated paperboard sheets SC1, SC2. When the corrugated paperboard sheets SC1, SC2 are produced in the required number, the drive of the main drive motor 8, the rotary-cylinder motor 101 and the anvil-cylinder motor 102 is stopped.

<<Effects of First Embodiment>>

A special cutting device for cutting a corrugated paperboard sheet into two small-size corrugated paperboard sheets is described in the Patent Document 2. This cutting device is exclusively used to cut a stack obtained by stacking a plurality of large-size corrugated paperboard sheets, into two sets each consisting of a stack of a plurality of small-size corrugated paperboard sheets, and disposed downstream of a die-cutter. It is conceivable to use a special sheet cutting device for sequentially cutting a single piece of corrugated paperboard sheet discharged from a slotter or a die-cutter, in place of the special cutting device for a stack. It is also conceivable to arrange this sheet cutting device at a position between a slotter and a die-cutter, or at a position downstream of and adjacent to a die-cutter. Generally, a sheet cutting device is configured such that a cylinder having a cutting blade fixed thereto and a feed roller are disposed in opposed relation to each other across a conveyance path. Differently, in the first embodiment, the die-cutter comprises the movable frame 90 supporting the three cylinders 73, 70, 71. Thus, as compared to a corrugated paperboard box making machine using the above sheet cutting device, a length of the corrugated paperboard box making machine 1 in the conveyance direction FD can be reduced.

In the first embodiment, the movable frame 90 is configured to be linearly lifted and lowered in a direction perpendicular to the conveyance path PL. Thus, as compared to a die-cutter in which a support frame supporting two or more of the three cylinders 73, 70, 71 is turned and therefore required to be spaced apart from the slotter by a distance corresponding to a range of the turning, a length of the die-cutter 7 in the conveyance direction FD can be reduced.

In the first embodiment, the die-cutter 7 comprises the front clamp mechanism 120 and the rear clamp mechanism 130, and further comprises the front support mechanism 140 and the rear support mechanism 150. Thus, the clamp mechanisms allow the movable frame 90 to be reliably retained in the lifted position or the lowered position. In addition, the support mechanisms allow the movable frame 90 to be stably retained in the lifted position or the lowered position.

In the first embodiment, the anvil cylinder 70 is used for both punching and cutting, in cooperation with the die cylinder 71, and the cutting blade 74 of the rotary cylinder 73, respectively. This allows the die-cutter 7 to be simplified in terms of mechanical configuration. Further, the rotary shafts of the three cylinders 73, 70, 71 are supported by the single movable frame 90 at given intervals. This makes it possible to precisely maintain each of a distance between the rotary shafts of the rotary cylinder 73 and the anvil cylinder 70 at a given value, and to accurately operate punching and cutting.

Second Embodiment

Figure 8:
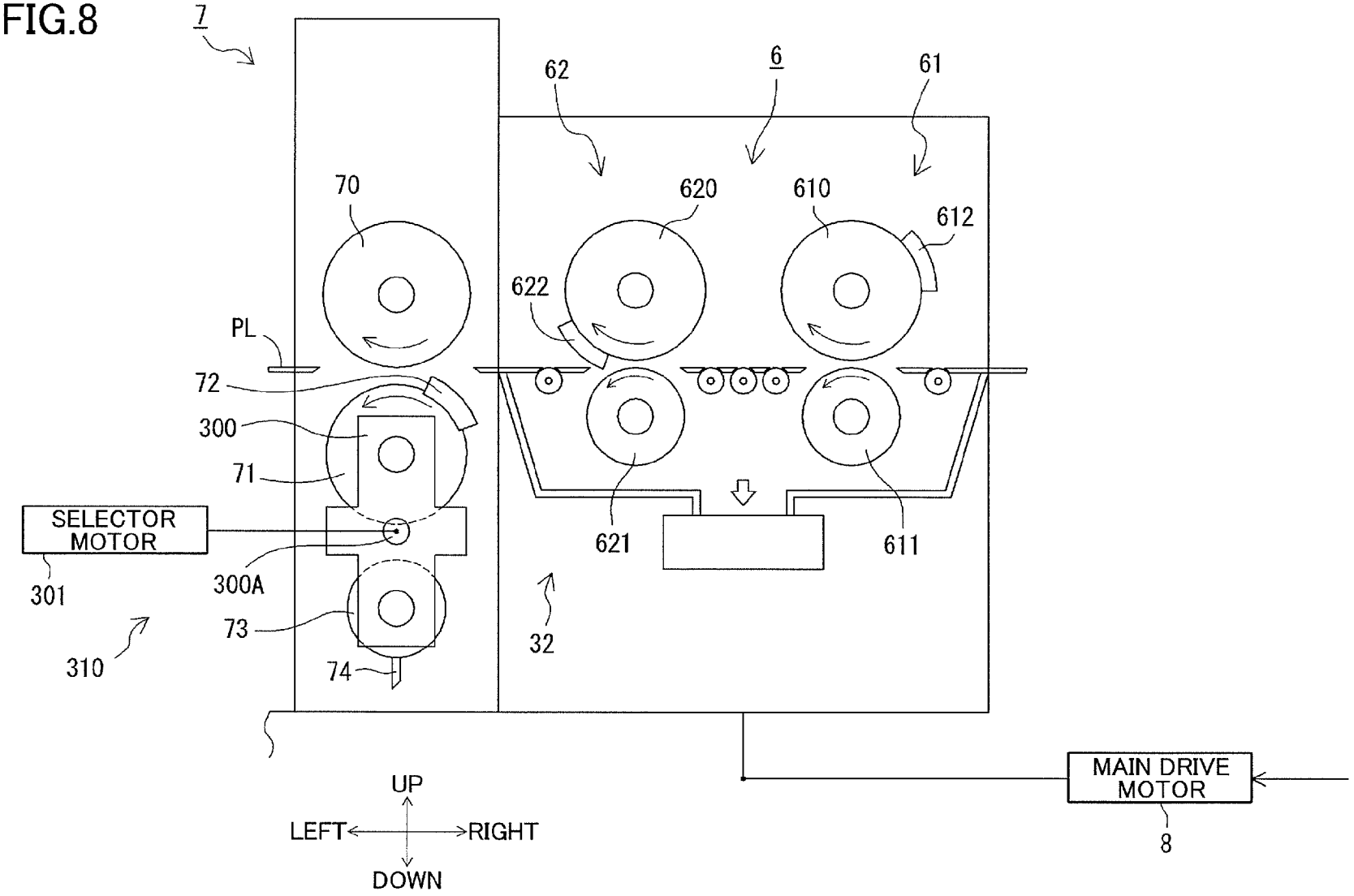
FIG. 8 is a front view illustrating configurations of a slotter and a die-cutter in a corrugated paperboard box making machine according to a second embodiment of the present invention.
Figure 9:
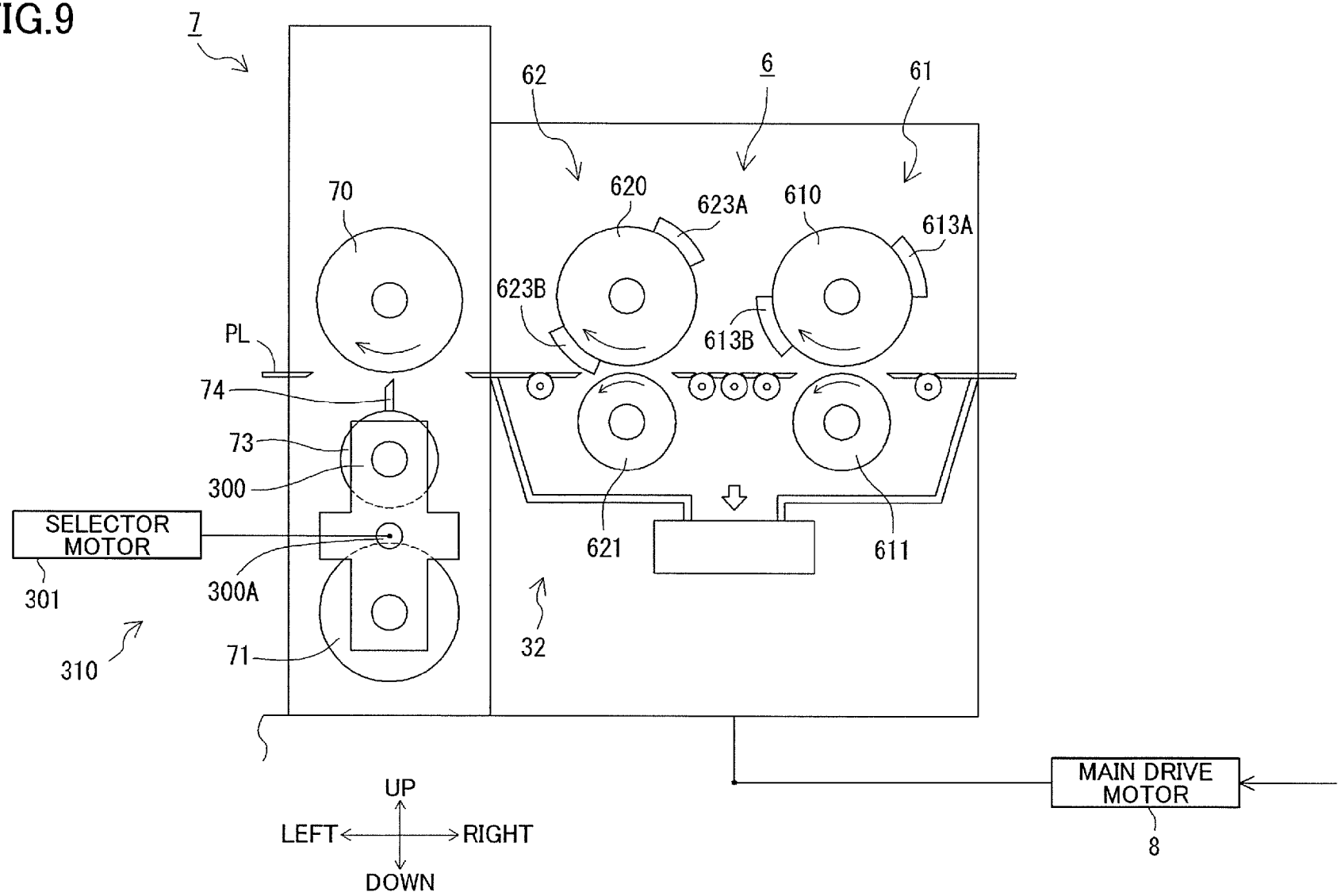
FIG. 9 is a front view illustrating the configurations of the slotter and the die-cutter in the corrugated paperboard box making machine according to the second embodiment, wherein operating conditions, such as an installation state of processing members (e.g., a slotter blade) for producing the corrugated paperboard sheet illustrated in FIG. 3, and a rotational state of three cylinders of a die-cutter, are changed from those in FIG. 8.

With reference to FIGS. 8 and 9, a corrugated paperboard box making machine according to a second embodiment will be described below. The second embodiment is different from the first embodiment in terms of a configuration of the die-cutter 7 for supporting the three cylinders 73, 70, 71, and therefore only the different configuration will be described. In the second embodiment, an element or component corresponding to that in the first embodiment will be described by assigning the same reference numeral or code thereto.

<<General Configuration>>

A corrugated paperboard box making machine 1 according to the second embodiment is different from the first embodiment in terms of a configuration of a die-cutter 7. Thus, FIG. 8 illustrates only a slotter 6 and the die-cutter 7. The remaining configuration in the second embodiment is the same as the configuration illustrated in FIG. 1. In FIG. 8, an anvil cylinder 70 of the die-cutter 7 is disposed at a fixed position above a conveyance path PL. A rotary shaft of the anvil cylinder 70 is rotatably supported by a stationary frame of the die cutter 7. A turnable frame 300 is disposed below the conveyance path PL. A pivot shaft 300A is fixed to an intermediate portion of the turnable frame 300, and rotatably supported by the stationary frame of the die-cutter 7. Rotary shafts of a die cylinder 71 and a rotary cylinder 73 are arranged at positions adjacent to respective opposite ends of the turnable frame 300 and spaced apart from the pivot shaft 300A in opposite directions and in a direction perpendicular to the pivot shaft 300A. The turnable frame 300 rotatably supports opposite ends of the rotary shaft of the die cylinder 71, and opposite ends of the rotary shaft of the rotary cylinder 73.

In order to prevent the die cylinder 71 and the rotary cylinder 73 from colliding with the frame of the slotter 6 during turning of the turnable frame 300 supporting the die cylinder 71 and the rotary cylinder 73, the pivot shaft 300A is disposed to be spaced apart from a frame of the slotter 6 in a conveyance direction FD by a distance corresponding to a range of the turning of the turnable frame 300 and others.

A selector motor 301 is fixed to the stationary frame of the die-cutter 7, and coupled to the pivot shaft 300A of the turnable frame 300. The selector motor 301 is operable to turn and position the turnable frame 300 to/in either one of a punching-enabling turn position where the die cylinder 71 is disposed in opposed relation to the anvil cylinder 70 across the conveyance path PL, as illustrated in FIG. 8, and a cutting-enabling turn position where the rotary cylinder 73 is disposed in opposed relation to the anvil cylinder 70 across the conveyance path PL, as illustrated in FIG. 9. When the turnable frame 300 is set in the turn position illustrated in FIG. 8, a punching die 72 of the die cylinder 71 becomes able to form the punched-out patterns D11, D12 in the corrugated paperboard sheet SS1 illustrated in FIG. 2. When the turnable frame 300 is set in the turn position illustrated in FIG. 9, a cutting blade 74 of the rotary cylinder 73 becomes able to form a central cut line CL in the corrugated paperboard sheet SS2 illustrated in FIG. 3, i.e., cut the corrugated paperboard sheet SS2 into two small-size corrugated paperboard sheets SC1, SC2. A turning mechanism 310 for turning the rotary cylinder 73 and the die cylinder 71 to the turn position illustrated in FIG. 8 or the turn position illustrated in FIG. 9 is made up of the selector motor 301, the turnable frame 300, the pivot shaft 300A and others.

An anvil-cylinder motor 102 is fixed to the stationary frame of the die cutter 7, and coupled to the rotary shaft of the anvil cylinder 70. A rotary-cylinder motor 101 and a die-cylinder motor 103 are fixed to the turnable frame 300, and coupled, respectively, to the rotary shaft of the rotary cylinders 73 and the rotary shaft of the die cylinder 71.

In order to retain the turnable frame 300 in the turn position illustrated in FIG. 8 or the turn position illustrated in FIG. 9, a non-illustrated anti-turning clamp mechanism is provided. The anti-turning clamp mechanism has the same fundamental configuration as that of the clamp mechanisms 120, 130 in the first embodiment. That is, the anti-turning clamp mechanism comprises a pair of lockable members and an air cylinder. The pair of lockable members are fixed to the turnable frame 300 at respective positions adjacent to opposite ends thereof. Each of the lockable members is internally formed with a retention groove having an opening on a line extending in a radial direction from a center located at the pivot shaft 300A of the turnable frame 300. The air cylinder is fixed to the stationary frame of the die-cutter 7. A retaining member is fixed to a distal end of a piston rod of the air cylinder. A guide member having a through-hole is fixed to the stationary frame of the die-cutter to guide the retaining member to the retention groove of one of the lockable members. When the turnable frame 300 is set in the turn position illustrated in FIG. 8 or the turn position illustrated in FIG. 9, and then the piston rod of the air cylinder is extended, the retaining member is fitted into the retention groove of one of the lockable members. Based on this fitting, the turnable frame 300 is retained in the turn position illustrated in FIG. 8 or the turn position illustrated in FIG. 9.

An electrical configuration in the second embodiment is provided with: a selector-motor driver for driving the selector motor 301, in place of the oil-hydraulic-cylinder driver 242 in the electrical configuration illustrated in FIG. 7; and an anti-turning-clamp driver for driving the air cylinder of the anti-turning clamp mechanism, in place of the clamp driver 243 and the support-member driver 244. The electrical configuration in the second embodiment is provided with a cylinder-motor driver having the same configuration as the cylinder-motor driver 241 of the electrical configuration in the first embodiment. A die-cutter controller 240 in the second embodiment is operable to send control instruction information to the selector-motor driver and the anti-turning-clamp driver. The selector-motor driver is operable to drive the selector motor 301 in a rotational direction and at a motor speed according to the control instruction information, or stop the drive according to the control instruction information. The anti-turning-clamp driver is operable to drive the air cylinder according to the control instruction information.

<<Operation and Functions of Second Embodiment>>

An operation and functions in the second embodiment will be described below. The second embodiment is different from the first embodiment in terms of only an operation of the die-cutter 7, and therefore the following description will me made with a focus on the operation of the die-cutter 7.

<Production of Normal Sheet-Length Type Corrugated Paperboard Sheet SS1>

In advance of start of production of the normal sheet-length type corrugated paperboard sheet SS1, an operator performs a preparatory work, such as the work of wrappingly attaching a printing plate member 41 suitable for the production of the corrugated paperboard sheet SS1, in the same manner as that in the first embodiment. In response to an operator's manual operation of an order start button 231 of an operation panel 230 in order to start the production of the normal sheet-length type corrugated paperboard sheet SS1, a management unit 200 sequentially reads control instruction information for producing the normal sheet-length type corrugated paperboard sheet SS1, from a program memory 210, and sends the control instruction information to the die-cutter controller 240 and a controller group 250. The die-cutter controller 240 controls the selector-motor driver to rotate the selector motor 301 in such a manner as to allow the turnable frame 300 to be turned to the punching-enabling turn position where the die cylinder 71 is disposed in opposed relation to the anvil cylinder 70 across the conveyance path PL, as illustrated in FIG. 8.

When the turnable frame 300 reaches the punching-enabling turn position, the die-cutter controller 240 controls the anti-turning-clamp driver to cause the piston rod of the air cylinder of the anti-turning clamp mechanism to be extended. As a result of this control, the retaining member of the anti-turning clamp mechanism is fitted into one of the retention grooves, so that the turnable frame 300 is retained in the punching-enabling turn position. In the punching-enabling turn position, the anvil cylinder 70 and the die cylinder 71 are positioned in such a manner as to be disposed in opposed relation to each other across the conveyance path PL, as illustrated in FIG. 8.

After completion of positioning of the anvil cylinder 70 and the die cylinder 71, the management unit 200 instructs the controller group 250 to drive a main drive motor 8 and a drive-source group 253. The controller group 250 controls a main-drive-motor driver 251 and a driver group 252. The management unit 200 also instructs the die-cutter controller 240 to drive the anvil-cylinder motor 102 and the die-cylinder motor 103 in order to produce the normal sheet-length type corrugated paperboard sheet SS1. The die-cutter controller 240 controls the cylinder-motor driver 241 to cause the anvil cylinder 70 and the die cylinder 71 to rotate in the respective directions indicated by the arrowed lines in FIG. 8 and at a motor speed coincident with a corrugated paperboard sheet conveyance speed. The die-cutter controller 240 also controls the cylinder-motor driver 241 to cause the rotary cylinder 73 to be maintained in a stopped state.

Along with rotation of the main drive motor 8, corrugated paperboard sheets SS are fed from a feeding apparatus 2 one-by-one, and each of the corrugated paperboard sheets SS is printed, creased, slotted and corner-cut, and the die-cutter 7 operates to punch the corrugated paperboard sheet SS1 to form the punched-out patterns D11, D12. The above series of processings will be repeatedly performed plural times corresponding to a required sheet number determined according to an order. When the corrugated paperboard sheet SS1 is produced in the required number, the drive of the main drive motor 8, the anvil-cylinder motor 102 and the die-cylinder motor 103 is stopped.

<Production of Short Sheet-Length Type Small-Size Corrugated Paperboard Sheet SS1>

In advance of start of production of the small-size corrugated paperboard sheets SC1, SC2, an operator performs a preparatory work, such as the work of wrappingly attaching a printing plate member 44 suitable for the production of the small-size corrugated paperboard sheets SC1, SC2, in the same manner as that in the first embodiment. In response to an operator's manual operation of the order start button 231 of the operation panel 230 in order to start the production of the small-size corrugated paperboard sheets SC1, SC2, the management unit 200 sequentially reads control instruction information for producing the small-size corrugated paperboard sheets SC1, SC2, from the program memory 210, and sends the control instruction information to the die-cutter controller 240 and the controller group 250. The die-cutter controller 240 controls the anti-turning-clamp driver to cause the piston rods of the anti-turning clamp mechanism to be retracted. As a result of this control, the retaining member of the anti-turning clamp mechanism is pulled out of the retention groove, so that the retention of the turnable frame 300 by the anti-turning clamp mechanism is released.

The die-cutter controller 240 controls the selector-motor driver to rotate the selector motor 301 in such a manner as to allow the turnable frame 300 to be turned to the cutting-enabling turn position where the rotary cylinder 73 is disposed in opposed relation to the anvil cylinder 70 across the conveyance path PL, as illustrated in FIG. 9. When the turnable frame 300 reaches the cutting-enabling turn position, the die-cutter controller 240 controls the anti-turning-clamp driver to cause the piston rod of the air cylinder of the anti-turning clamp mechanism to be extended. As a result of this control, the retaining member of the anti-turning clamp mechanism is fitted into the other retention groove, so that the turnable frame 300 is retained in the cutting-enable turn position. In the cutting-enable turn position, the rotary cylinder 73 and the anvil cylinder 70 are positioned in such a manner as to be disposed in opposed relation to each other across the conveyance path PL, as illustrated in FIG. 9.

After completion of positioning of the rotary cylinder 73 and the anvil cylinder 70, the management unit 200 instructs the controller group 250 to drive the main drive motor 8 and the drive-source group 253. The controller group 250 controls the main-drive-motor driver 251 to cause the main drive motor 8 to rotate at a motor speed suitable for the production of the small-size corrugated paperboard sheets SC1, SC2, and controls the driver group 252 in order to perform the sheet feeding, the printing, the creasing, the slotting and others. The management unit 200 also instructs the die-cutter controller 240 to drive the rotary-cylinder motor 101 and the anvil-cylinder motor 102 in order to the small-size corrugated paperboard sheets SC1, SC2. The die-cutter controller 240 controls the cylinder-motor driver 241 to cause the rotary cylinder 73 and the anvil cylinder 70 to rotate in the respective opposite directions and at a motor speed coincident with the corrugated paperboard sheet conveyance speed to be determined by the motor speed of the main drive motor 8. The die-cutter controller 240 also controls the cylinder-motor driver 241 to cause the die cylinder 71 to be maintained in a stopped state.

Along with rotation of the main drive motor 8, corrugated paperboard sheets SS are fed from the feeding apparatus 2 one-by-one, and each of the corrugated paperboard sheets SS is printed, creased, slotted to form the central slots MS1 to MS3, and corner-cut. The corrugated paperboard sheet SS2 after being processed is discharged from the slotter 6. The die-cutter 7 operates to cut the corrugated paperboard sheet SS2 in accordance with the central cut line CL. When the corrugated paperboard sheets SC1, SC2 are produced in a required number, the drive of the main drive motor 8, the rotary-cylinder motor 101 and the anvil-cylinder motor 102 is stopped.

<<Effects of Second Embodiment>>

In the second embodiment, the die-cutter 7 is configured such that the turnable frame 300 is turned about the pivot shaft 300A. Thus, as compared to the first embodiment in which the movable frame 90 supporting the three cylinders 73, 70, 71 and therefore inevitably becoming heavy in weight is lifted and lowered, a load imposed on the selector motor 301 is reduced, so that it becomes possible to quickly perform switching between the rotary cylinder 73 and the die cylinder 71.

In the second embodiment, the die-cutter 7 is configured such that the turn position of the turnable frame 300 is mechanically retained by the anti-turning clamp mechanism. Thus, as compared to a configuration in which the turn position of the turnable frame 300 is electrically retained by means of excitation control of the selector motor 301, it becomes possible to reliably retain the turn position of the turnable frame 300 during cutting or punching.

In the second embodiment, the anvil cylinder 70 is used for both punching and cutting, in cooperation with the die cylinder 71, and the cutting blade 74 of the rotary cylinder 73, respectively. In addition, the anvil cylinder 70 is rotated in the same direction during both the punching and cutting. This makes it possible to simplify a mechanical configuration of the die-cutter 7, and simplify rotation control of the anvil-cylinder motor 102.

In the second embodiment, the die-cutter 7 comprises the turnable frame 300 supporting the die cylinder 71 and the rotary cylinder 73. Thus, as compared to the aforementioned conventional corrugated paperboard box making machine using the special sheet cutting device for sequentially cutting a single piece of corrugated paperboard sheet, it becomes possible to reduce a length of the corrugated paperboard box making machine 1 in the conveyance direction FD.

[Modifications]

An advantageous embodiment of the invention has been shown and described. It is obvious to those skilled in the art that various changes and modifications may be made therein without departing from the spirit and scope thereof as set forth in appended claims.

Figure 10:
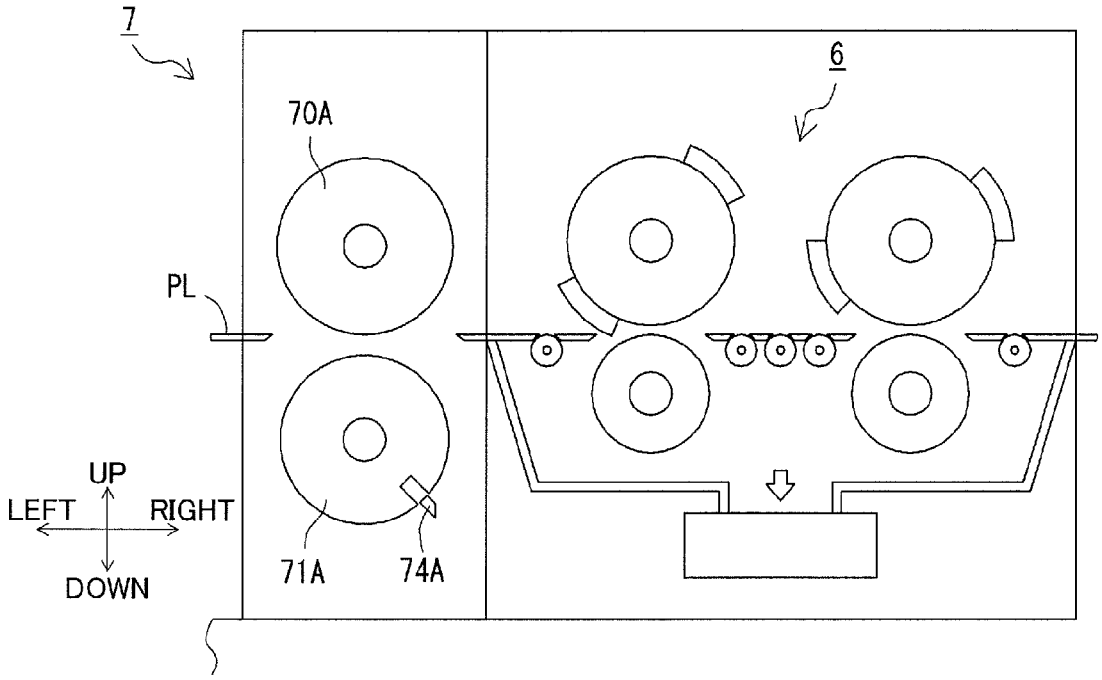
FIG. 10 is a front view illustrating an example of modification of the die-cutter, wherein a cutting blade is configured to be displaced between a cutting position where the cutting blade is disposed to protrude from an outer peripheral surface of a die cylinder, and a non-cutting position where the cutting blade is retracted inside the die cylinder.

(1) In the first and second embodiments, the cutting blade 74 is fixed to the rotary cylinder 73. However, the present invention is not limited thereto. For example, the cutting blade may be configured as a cutting blade 74A as illustrated in FIG. 10, wherein the cutting blade 74A is attached to a die cylinder 71A in such a manner as to be displaceable between a cutting position where the cutting blade 74A is disposed to protrude from an outer peripheral surface of the die cylinder 71A, and a non-cutting position where the cutting blade 74A is retracted inside the die cylinder 71A. In this modified embodiment, the die cylinder 71A and an anvil cylinder 70A are disposed at respective given positions of the stationary frame of the die-cutter 7, in opposed relation to each other in an up-down direction across the conveyance path PL. In the case where the corrugated paperboard sheet SS2 is cut into the small-size corrugated paperboard sheets SC1, SC2, and punched, a wooden frame having a punching die is wrappingly attached to a region of an outer peripheral surface of the die cylinder 71A other than an attached position of the cutting blade 74A.

Figure 11:
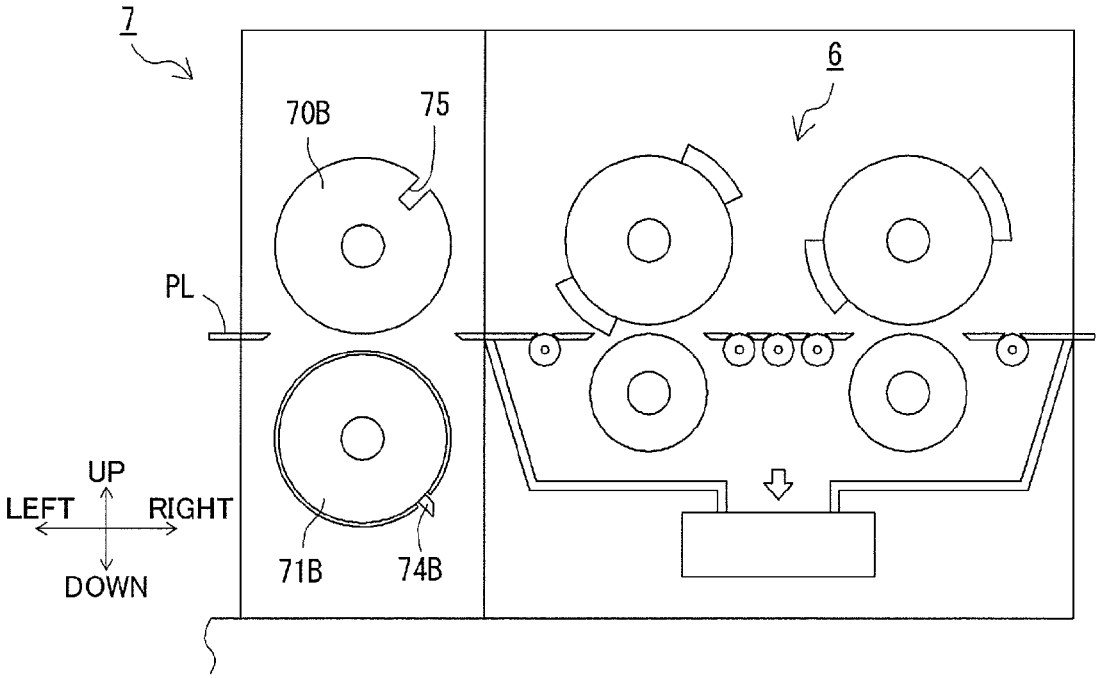
FIG. 11 is a front view illustrating another example of the modification of the die-cutter, wherein a cutting blade is fixed to an outer peripheral surface of a die cylinder at a given position, and an anvil cylinder has a recess for allowing the cutting blade to be inserted thereinto.

(2) In the modified embodiment illustrated in FIG. 10, the cutting blade 74A is displaced between the cutting position where the cutting blade 74A is disposed to protrude from the outer peripheral surface of the die cylinder 71A, and the non-cutting position where the cutting blade 74A is retracted inside the die cylinder 71A. Alternatively, the cutting blade may be configured as a cutting blade 74B as illustrated in FIG. 11, wherein the cutting blade 74B is fixed at a fixed position of an outer peripheral surface of a die cylinder 71B, and an anvil cylinder 70B has a recess 75 for allowing the cutting blade 74B to be inserted thereinto. In this modified embodiment, the die cylinder 71B and the anvil cylinder 70B are disposed at respective given positions of the stationary frame of the die-cutter 7, in opposed relation to each other in an up-down direction across the conveyance path PL. In the case where the corrugated paperboard sheet SS2 is cut into the two small-size corrugated paperboard sheets SC1, SC2, and punched, a wooden frame having a punching die is wrappingly attached to a region of an outer peripheral surface of the die cylinder 71B other than a fixed position of the cutting blade 74B. A rotational phase of the die cylinder 71B with respect to the anvil cylinder 70B is set to a given cutting rotational phase to allow the cutting blade 74B to cut the corrugated paperboard sheet SS2 into the two small-size corrugated paperboard sheets SC1, SC2 when the corrugated paperboard sheet SS2 passes through between the anvil cylinder 70B and the die cylinder 71B. The rotational phase of the die cylinder 71B with respect to the anvil cylinder 70B is also set to a given non-cutting rotational phase to prevent the cutting blade 74B from cutting the corrugated paperboard sheet SS1 when the corrugated paperboard sheet SS1 passes through between the anvil cylinder 70B and the die cylinder 71B. In the case where the rotational phase of the die cylinder 71B is set to the given non-cutting rotational phase, the cutting blade 74B is inserted into the recess 75 when the cutting blade 74B becomes opposed to the anvil cylinder 70B. In this modified embodiment, the cutting blade 74B may be directly fixed to the outer peripheral surface of the die cylinder 71B, or may be fixed to the die cylinder 71B in such a manner that a wooden frame having the cutting blade 74B fixed thereto is fixed to the outer peripheral surface of the die cylinder 71B by a screw or the like. In the die-cutter illustrated in FIG. 11, the cutting blade 74B is directly fixed to the outer peripheral surface of the die cylinder 71B, and a wooden frame for fixing a punching die is wrappingly attached to a region of the outer peripheral surface of the die cylinder 71B other than a fixed position of the cutting blade 74B.

(3) In the first embodiment, the die-cutter 7 is configured such that the movable frame 90 is automatically lifted and lowered by the oil hydraulic cylinders 104, 105 under control of the die-cutter controller 240. However, the present invention is not limited thereto. For example, an operator may manually lift and lower the movable frame by operating a hydraulic jack or the like.

(4) In the second embodiment, the die-cutter 7 is configured such that the turnable frame 300 is automatically turned by the selector motor 301 under control of the die-cutter controller 240. However, the present invention is not limited thereto. For example, an operator may manually turn the turnable frame by operating a handle coupled to the turnable frame via a gear train.

(5) In the first and second embodiments, the slotter 6 is configured to form the central slots MS1 to MS3 in the corrugated paperboard sheet SS2. However, the present invention is not limited thereto. For example, in the modified embodiment illustrated in FIG. 10 or the modified embodiment illustrated in FIG. 11, the central slots MS1 to MS3 may be formed in the corrugated paperboard sheet SS2 by a punching die wrappingly attached to the die cylinder 71A or the die cylinder 71B.

(6) In the first embodiment, the die-cutter 7 is configured such that the three cylinders 73, 70, 71 are supported by the movable frame. However, the present invention is not limited thereto. For example, the movable frame may consist of three movable frames each supporting a respective one of the three cylinders 73, 70, 71, or may comprise a first movable frame supporting the rotary cylinder, and a second movable frame supporting the remaining two cylinders.

What is claimed is:

1. A corrugated paperboard box making machine for slotting and punching a corrugated paperboard sheet conveyed along a given conveyance path, comprising:

a slotter for slotting a corrugated paperboard sheet to form slots extending along a conveyance direction, respectively, in downstream and upstream ends of the corrugated paperboard sheet in the conveyance direction;

a die-cutter disposed downstream of the slotter, the die-cutter including a die cylinder, extending along a direction perpendicular to the conveyance direction, to which a punching die having a shape corresponding to a desired punched-out pattern is attached and an anvil cylinder extending along the die cylinder;

a cutting blade extending along the direction perpendicular to the conveyance direction and fixed to a rotary cylinder rotatable about an axis parallel to a rotational axis of the anvil cylinder for cutting, in cooperation with the anvil cylinder of the die-cutter, a single piece of the corrugated paperboard sheet slotted by the slotter, into two small-size corrugated paperboard sheets, along the direction perpendicular to the conveyance direction; and a displacement mechanism configured to displace the rotary cylinder having the cutting blade fixed thereto, the anvil cylinder and the die cylinder in such a manner as to allow the rotary cylinder, the anvil cylinder and the die cylinder to be selectively set in a cutting position for cutting the single piece of the corrugated paperboard sheet into the two small-size corrugated paperboard sheets where the rotary cylinder is located in adjacent relation to the conveyance path and in opposed relation to the anvil cylinder across the conveyance path, and a punching position for the punching die's punching the corrugated paperboard sheet where the rotary cylinder is located spaced apart from the conveyance path, and the die cylinder is located in opposed relation to the anvil cylinder across the conveyance path;

wherein the displacement mechanism comprises a support frame supporting the rotary cylinder, the anvil cylinder and the die cylinder, and a driving device for displacing the support frame in an up-down direction.

2. A corrugated paperboard box making machine for slotting and punching a corrugated paperboard sheet conveyed along a given conveyance path, comprising:

a slotter for slotting a corrugated paperboard sheet to form slots extending along a conveyance direction, respectively, in downstream and upstream ends of the corrugated paperboard sheet in the conveyance direction;

a die-cutter disposed downstream of the slotter, the die-cutter including a die cylinder, extending along a direction perpendicular to the conveyance direction, to which a punching die having a shape corresponding to a desired punched-out pattern is attached and an anvil cylinder extending along the die cylinder; and a cutting blade, extending along the direction perpendicular to the conveyance direction and fixedly attached onto an outer peripheral surface of the die cylinder, for cutting, in cooperation with the anvil cylinder of the die-cutter, a single piece of the corrugated paperboard sheet slotted by the slotter, into two small-size corrugated paperboard sheets, along the direction perpendicular to the conveyance direction;

wherein the anvil cylinder has a recess formed in an outer peripheral surface thereof at a phase position corresponding to a phase of the cutting blade fixedly attached onto the outer peripheral surface of the die cylinder; and wherein a distal end of the cutting blade is inserted into the recess so as to be set in a punching position for the punching die's punching the corrugated paperboard sheet where the cutting blade is precluded from cutting the corrugated paperboard sheet and the distal end of the cutting blade is not inserted into the recess so as to be set in a cutting position for the cutting blade's cutting the single piece of the corrugated paperboard sheet into the two small-size corrugated paperboard sheets.

* * * * *